US006342894B1

(12) United States Patent
Nojiri

(10) Patent No.: US 6,342,894 B1
(45) **Date of Patent: *Jan. 29, 2002**

(54) ICON DISPLAY METHOD

(75) Inventor: Minoru Nojiri, Zushi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/222,722

(22) Filed: Apr. 1, 1994

Related U.S. Application Data

(63) Continuation of application No. 07/855,087, filed on Mar. 20, 1992, now abandoned.

(30) Foreign Application Priority Data

| | | |
|---|---|---|
| Mar. 22, 1991 | (JP) | 3-058461 |
| Jul. 8, 1991 | (JP) | 3-166647 |
| Jul. 8, 1991 | (JP) | 3-166648 |
| Jul. 8, 1991 | (JP) | 3-166650 |

(51) Int. Cl.[7] ..... G09G 5/00

(52) U.S. Cl. ..... 345/531; 345/473; 345/810; 345/861

(58) Field of Search ..... 345/156, 122, 345/145, 133, 146, 131, 157, 185, 202, 168, 473, 344, 348, 349, 351–354, 501, 555, 560, 531, 474, 440, 810, 861; 395/157, 159, 139, 348, 349, 350, 351; 364/188

(56) References Cited

U.S. PATENT DOCUMENTS

| | | | | |
|---|---|---|---|---|
| 4,290,128 A | * | 9/1981 | Estabrook | 368/1 |
| 4,813,013 A | * | 3/1989 | Durn | 340/747 |
| 4,901,221 A | * | 2/1990 | Kodosky et al. | 364/200 |
| 4,951,039 A | * | 8/1990 | Schwendeman et al. | 340/725 |
| 4,954,969 A | * | 9/1990 | Tsumura | 345/202 |
| 5,021,976 A | * | 6/1991 | Wexelblat et al. | 345/356 |
| 5,101,197 A | * | 3/1992 | Hix et al. | 345/157 |
| 5,129,011 A | * | 7/1992 | Nishikawa et al. | 345/202 |
| 5,134,560 A | * | 7/1992 | Ferriter et al. | 395/159 |
| 5,140,677 A | * | 8/1992 | Fleming etal. | 395/159 |
| 5,169,342 A | * | 12/1992 | Steele et al. | 395/159 |
| 5,367,626 A | * | 11/1994 | Morioka et al. | 395/159 |
| 5,442,795 A | * | 8/1995 | Levine et al. | 345/357 |
| 5,479,602 A | * | 12/1995 | Baecker et al. | 395/139 |

FOREIGN PATENT DOCUMENTS

| | | | |
|---|---|---|---|
| GB | 2156636 | * 10/1985 | 340/725 |

OTHER PUBLICATIONS

Bicycle Solitaire, Players Guide, Swfte International Ltd. 1991. Printed in U.S.A 0491.*

* cited by examiner

*Primary Examiner*—Lun-Yi Lao
(74) *Attorney, Agent, or Firm*—Fitzpatrick Cella Harper & Scinto

(57) ABSTRACT

In a display control method and a display control apparatus therefor, a plurality of icon fonts can be registered for one object, and the object can be explained using the plurality of icons by switching over the icon to be displayed to express the object. A plurality of icon patterns can be registered for a single function, and registered icon patterns are stored according to the corresponding functions in an icon display data unit. When an instruction to switch over the presently displayed icon pattern to another icon pattern is given by a controller of, for example, a mouse, the presently displayed icon pattern is switched over to a subsequent registered icon pattern.

21 Claims, 16 Drawing Sheets

IFNTREC

CDNO : PRESENTLY DISPLAYED ICON NO.

ITNO : NUMBER OF REGISTERED FONTS

IFNTREG(n) : REGISTERED FONTS

SCONREC

CONTROL DATA

| | | | | | | | | |
|---|---|---|---|---|---|---|---|---|
| f1 | 1 | 1 | 1 | 1 | 1 | 1 | 1 | 0 |
| f2 | 1 | 1 | 1 | 0 | 1 | 1 | 1 | 0 |
| f3 | 1 | 1 | 1 | 0 | 1 | 1 | 0 | 0 |
| f4 | 1 | 1 | 1 | 0 | 1 | 0 | 0 | 0 |
| f5 | 1 | 0 | 1 | 0 | 1 | 0 | 0 | 0 |
| f6 | 1 | 0 | 0 | 0 | 1 | 0 | 0 | 0 |
| f7 | 1 | 0 | 0 | 0 | 0 | 0 | 0 | 0 |

STARTING ADDRESS

| | |
|---|---|
| s1 | 4 |
| s2 | 8 |
| s3 | 12 |
| s4 | 16 |
| s5 | 20 |
| s6 | 24 |
| s7 | 28 |

ICON DISPLAY METHOD

This application is a continuation of application Ser. No. 07/855,087, filed Mar. 20, 1992 now abandoned.

BACKGROUND OF THE INVENTION

1. Field of the Invention

The present invention relates to icon display for a data processing apparatus, and more particularly, to an icon display method which has an improved operability and workability.

2. Description of the Related Art

In recent years, user interfaces for personal computers or work stations have been proposed, which assure easy handling of computers and user friendly operation by displaying a plurality of icons on a display screen. Sometimes, the meaning of an icon may not be self-evident from its form. Therefore, a supplementary explanation of the meanings of the icons is given by a help function or the like in some computer systems. In other systems, to make the displayed icon's contents clear, a display area for the single icon is enlarged so that the icon can be displayed in a larger icon font in the enlarged icon display area.

However, where the display area for the single icon is enlarged, although the icon can be discriminated at a glance, the number of icons displayed on the screen is decreased. Furthermore, where the display area for the single icon is reduced so that many icons can be displayed on one screen, it may be difficult for the operator to know the functions of the icons at a glance. Therefore, the operator interrupts the operation to refer to an attached pamphlet, such as a quick reference guide, for explanation of icons. Consequently, operability deteriorates.

Where it is impossible to know the functions of the icons because they are displayed in the small display areas, explanation may be offered by other methods, such as the help function. However, in that case, the operator must interrupt the operation to display of the help guidance screen and must learn the operation of displaying the help guidance screen. Consequently, operability deteriorates.

SUMMARY OF THE INVENTION

In view of the aforementioned drawbacks of the conventional icon display method, an object of the present invention is to provide an icon display method in which a single object is explained using a plurality of icons rather than a single icon.

To achieve the above object, the present invention provides an icon display method for a data processing apparatus having an icon display function, which comprises registration means for registering a plurality of icons for a single object, display means for displaying the icons registered by the registration means, and instruction means for instructing display of an immediately subsequently registered icon relative to the icon displayed by the display means.

Another object of the present invention is to provide an icon display method which enables a plurality of icons registered for a single object to be displayed at predetermined time intervals.

To achieve the above object, the present invention provides an icon display method for data processing apparatus having an icon display function, which comprises registration means for registering a plurality of icons for a single object, display means for displaying the icons registered by the registration means, instruction means for instructing display of all the registered icons relative to the icon displayed by the display means, and counting means for counting the time intervals during which the icons instructed by the instruction means are displayed. All the registered icons are displayed at predetermined time intervals counted by the counting means.

Another object of the present invention is to provide an icon display method in which a single object is expressed by a plurality of icons, the presently displayed icon and the subsequently displayed icon having a relation similar to the two sides of a card so that display of the icons is switched over by turning over the presently displayed icon.

To achieve the above object, the present invention provides an icon display method for a data processing apparatus having an icon display function, which comprises registration means for registering a plurality of icons for a single object, display means for displaying the icons registered by the registration means, instruction means for instructing display of an immediately subsequently registered icon relative to the icon displayed by the display means, and control means for controlling display of the subsequent icon which is instructed by the instruction means. The presently displayed icon and the subsequently displayed icon have a relation similar to the two sides of a card, and the presently displayed icon is turned over to display the subsequent icon.

It is further object of the present invention to provide a display control method in which a plurality of icon fonts can be registered for a single object or function and in which the object or function can be explained using the plurality of icon patterns by switching between displays of the icons representing the object or function, and a display control apparatus therefor.

To achieve the further object, the present invention provides a display control apparatus in which a plurality of icons are displayed on a display screen and in which various types of functions can be executed by designating the corresponding icons. The display control apparatus includes a registration unit for registering a plurality of icon patterns for a single function, a store for storing the plurality of icon patterns registered by the registration unit according to the function, and a switch-over unit that switches over the presently displayed icon pattern to another icon pattern stored in the store.

With respect to the further object, the present invention also provides a display control method in which a plurality of icons are displayed on a display screen and in which various types of functions can be executed by designating the corresponding icons. The method includes registering a plurality of icon patterns for a single function, storing the plurality of registered icon patterns according to the function, and switching over display of the present icon pattern to that of a subsequent icon pattern when an instruction to switch over the presently displayed icon pattern to another icon pattern is given.

DETAILED DESCRIPTION OF THE PREFERRED EMBODIMENTS

A first embodiment of the present invention will be described below in detail with reference to the accompanying drawings.

Figure 1:
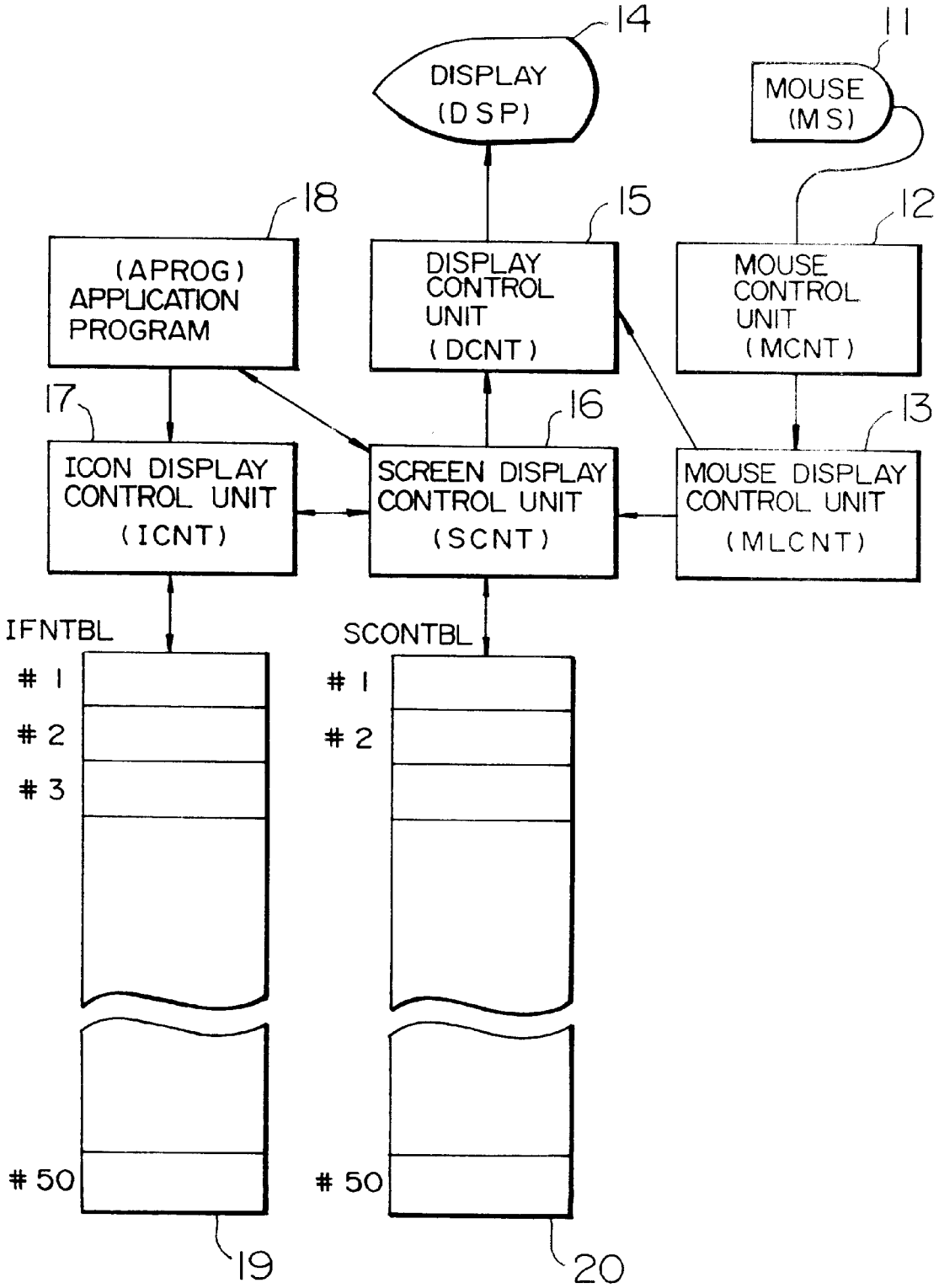
FIG. 1 is a block diagram of a personal computer showing an embodiment of the present invention.

FIG. 1 is a block diagram, illustrating the functions which are carried out on a data processing apparatus (a personal computer). In FIG. 1, a mouse (MS) 11 is a pointing device. A mouse control unit (MCONT) 12 controls the mouse 11 in terms of hardware. A mouse display control unit (MLCONT) 13 displays the operation of the mouse 11 on a screen. A display (DSP) 14 is a CRT in this embodiment. A display control unit (DCNT) 15 performs display control in terms of hardware. A screen display control unit (SCNT) 16 logically receives data whose display is requested and converts the received data into physical data. An icon display control unit (ICNT) 17 controls icon display, e.g., displays a subsequent icon among a plurality of registered icons or registers or deletes icons. An application program (APROG) 18 performs screen display requests, icon font registration and so on.

An icon display data table (IFNTBL) 19 stores font data for icon display and control data therefor. In this embodiment, 10 fonts are registered for each of 50 types of icons in the table 19. The table 19 is managed by the icon display control unit 17. A screen control data table (SCONTBL) 20 stores icon display control data including the screen display state. In this embodiment, data required to control display of 50 types of objects is registered in the table 20. The table 20 is managed by the screen display control unit 16.

Figure 2:
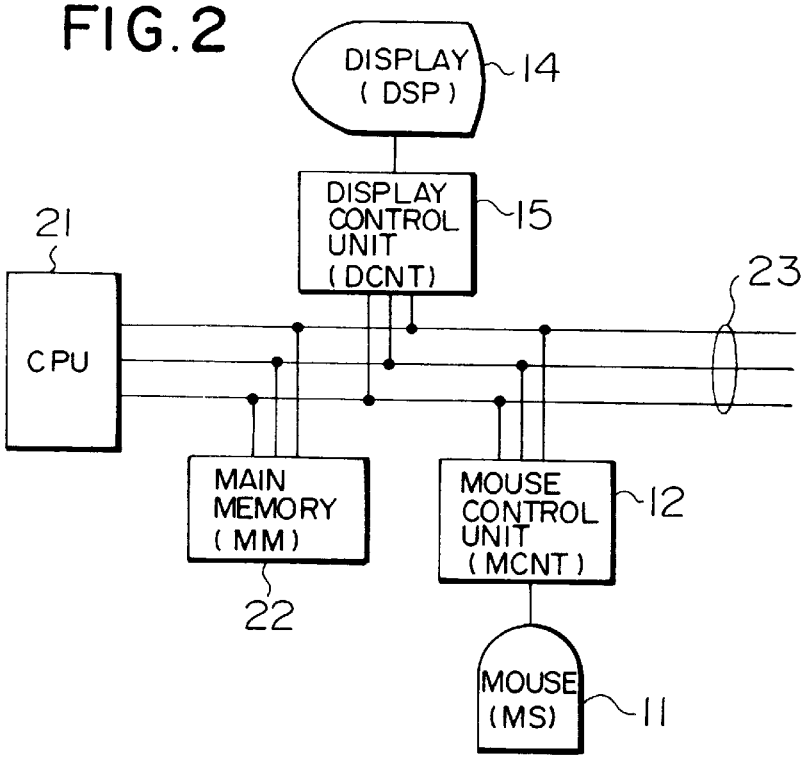
FIG. 2 shows a hardware structure of the personal computer shown in FIG. 1.

FIG. 2 is a view illustrating the hardware of the block diagram of FIG. 1. FIG. 2 shows a personal computer. In FIG. 2, a microprocessor (CPU) controls the entire personal computer according to the control procedures (programs) shown in FIGS. 8 through 10, which will be described later, and control data. A main memory (MM) 22 stores the mouse display control unit 13, the screen display control unit 16, the icon display control unit 17, the application program 18, the icon display data table 19, the screen control data table 20, the control procedures program and so on. A CPU bus 23 consists of an address bus, a data bus and control lines.

Figure 3:
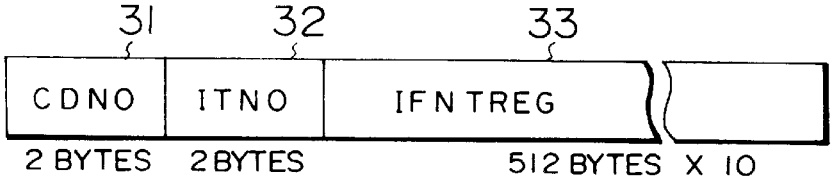
FIG. 3 illustrates the structure of one unit in an icon display data table.

FIG. 3 shows one unit of the icon display data table 19, that is, the icon display data format for one type of object. In FIG. 3, IFNTREC, the general term of the area in which one unit data is stored, consists of an area 31 for indicating the presently displayed icon number (CDNO), an area 32 in which a number of fonts (ITNO) currently registered for one type of object is stored, and an area 33 in which registered fonts (IFNTREG) are stored. Both the area 31 and the area 32 have 2 bytes, while the registered font area 33 has 5120 bytes which ensures that a maximum of 10 icon fonts, each having 512 bytes, can be registered.

Figure 4:
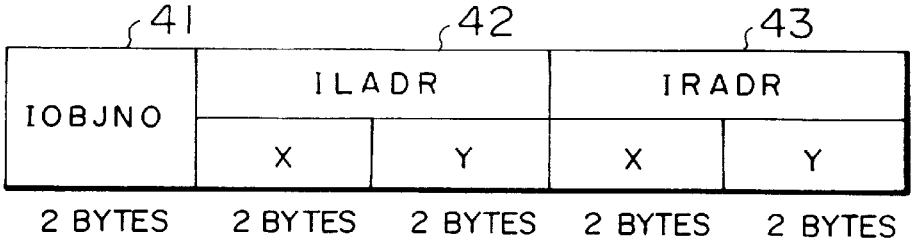
FIG. 4 illustrates the structure of one unit in a screen control data table.

FIG. 4 shows one unit of the screen control data table 20, that is, the screen control data format for one type of object. SCONREC, the general term of the area in which one unit of data is stored, consists of an area 41 in which data (IOBJNO) identifying an object is stored, and areas 42 and 43 in which the left upper position (ILADR) and the right lower position (IRADR) of an icon, required when the icon is displayed by the display 14, are respectively stored. The area 41 has 2 bytes, while both areas 42 and 43 have 4 bytes to allow the addresses on X and Y axes, each having two bytes, to be stored.

Registration, display and deletion of icons will be described below with reference to the related figures.

Figure 5:
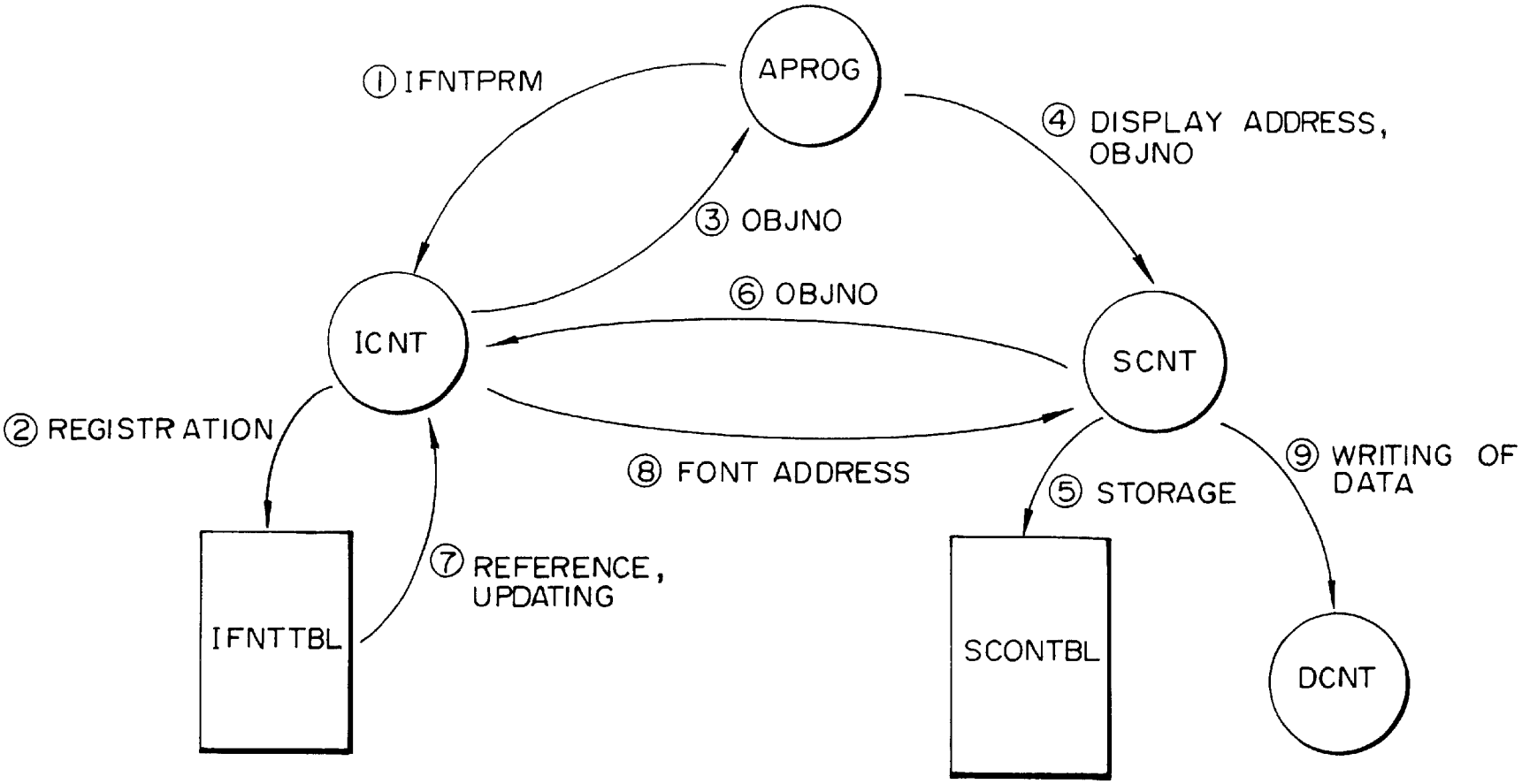
FIG. 5 is a transition diagram showing the control operations of registering a plurality of icon fonts.

FIG. 5 is a control transition diagram illustrating the flow of control operations of registering and displaying a plurality of icon fonts for one object.

1) An icon font registration parameter (IFNTPRM), which will be described in detail later, is handed from the application program (APROG) to the icon display control unit (ICNT).

2) The icon display control unit (ICNT) processes the icon font registration parameter (IFNTPRM) and stores the processed data in the icon display data table (IFNTBL). The icon display control unit (ICNT) informs the application program (APROG) of the stored position as the object identifier (OBJNO).

3) The application program (APROG) transfers the left upper address of the icon font on the display (DSP) and the object identifier (OBJNO) to the screen display control unit (SCNT), and thereby requests an initial icon display of the registered object.

4) The screen display control unit (SCNT) stores the object identifier (OBJNO) and the display address in the screen control data table (SCONTBL), and then transfers the object identifier (OBJNO) to the icon display control unit (ICNT) and thereby requests the icon font address of the object.

5) The icon display control unit (ICNT) detects the font address corresponding to the object identifier (OBJNO) from the icon display data table (IFNTBL), and lets the screen display control unit (SCNT) know the detected font address.

6) The screen display control unit (SCNT) writes the icon font at the display address in the display control unit (DCNT) corresponding to the display address on the display (DSP), by which the icon is displayed on the display (DSP).

Prior to description of switching over of icon display which is achieved by the operation of a mouse, various operations of the mouse button and the corresponding functions will be described first. In this embodiment, a two-button mouse is used for the following operations.

1. One click of the left button: positive instruction
2. Two clicks of the left button: execution of the object
3. One click of the right button: negative instruction
4. Two clicks of the right button: display of a subsequent font of the icon The operations of Items 1, 2 and 3, which are respectively processed by the mouse control unit (MCNT), the mouse display control unit (MLCNT) and the screen display control unit (SCNT) in this embodiment, have no direct relation to the present invention and a description of their operation is omitted.

The flow of control operations when the right button is clicked twice will be described below with reference to FIG. 6.

1) When the operator (user) operates the mouse (MS), the mouse display control unit (MLCNT) detects the contents of that operation through the mouse control unit (MCNT). If the contents of the operation are to move the mouse, the mouse display control unit (MLCNT) writes the data on the movement of the mouse in the display control unit (DCNT) to sequentially display the icon representing the mouse on the display (DSP) according to the movement.

2) If the data from the mouse control unit (MCNT) indicates the button operation, the mouse display control unit (MLCNT) notifies both the physical address (X and Y coordinate values) of the mouse on the display (DSP) and the contents of the button operation (right/left button and one/two clicks) to the screen display control unit (SCNT).

3) The screen display control unit (SCNT) executes the process corresponding to the contents of the button operation. For example, if the right button is clicked twice, the screen display control unit, knowing that it indicates the request for display of a subsequent icon font, detects the SCONREC having the ILADR and IRADR corresponding to the X and Y coordinate values received from the mouse display control unit (MLCNT) by referring to the address (ILADR, IRADR) of the one unit (SCONREC) in the screen control data table (SCONTBL) to search for the object identifier (OBJNO). Next, the screen display control unit (SCNT) transfers the detected object identifier (OBJNO) to the icon display control unit (ICNT) and thereby requests the address of an icon font to be displayed subsequently.

4) Thereafter, the same operation as that described in 5) and 6) in connection with FIG. 5 is executed, by which a subsequent icon font is displayed on the display (DSP).

The process of registration and deletion of a plurality of icon fonts and that of display of a subsequent icon font will be described below with reference to FIGS. 7 through 10.

Figure 7:
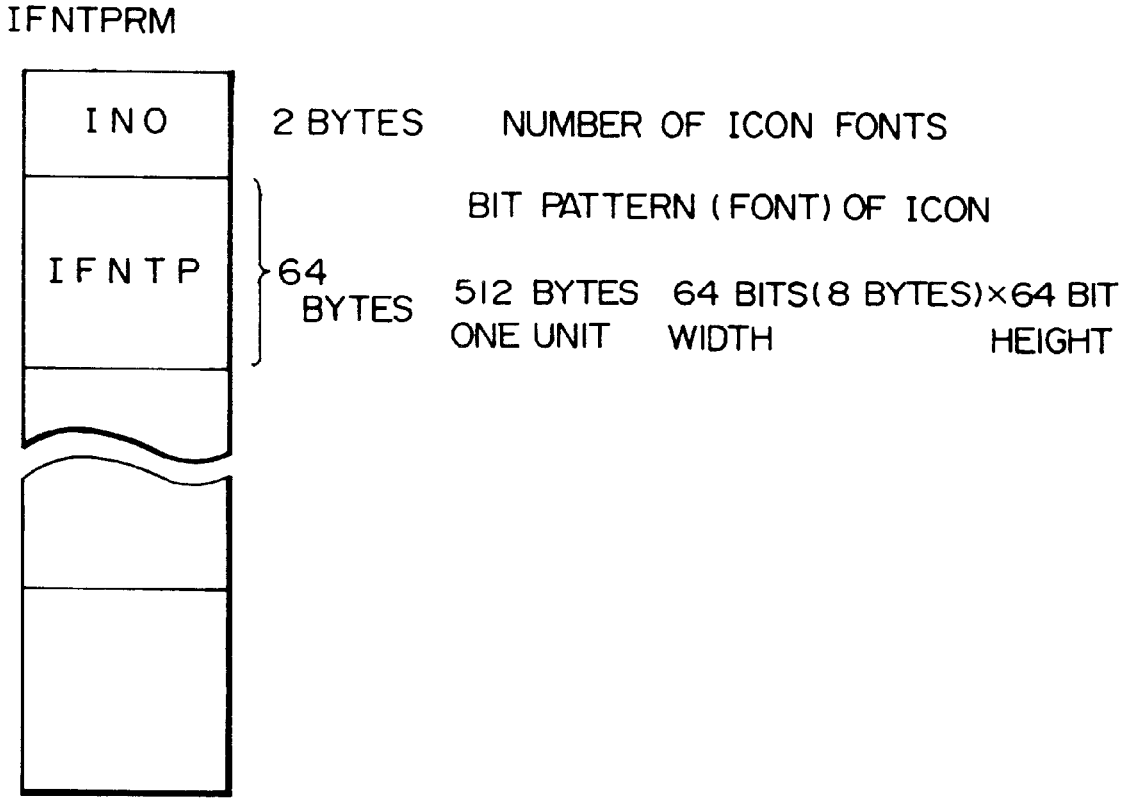
FIG. 7 illustrates an icon font registration parameter.

FIG. 7 illustrates the contents of the icon font registration parameter (IFNTPRM) when the application program (APROG) registers a plurality of icon fonts for a single object. As shown in FIG. 7, IFNTPRM is made up of a number of icon fonts (INO) and a font pattern (IFNTP). The number of icon fonts (INO) is an area in which the number of registered font patterns (IFNTP) is indicated, and has 2 bytes. In this embodiment, since the icon font is designed to have a bit pattern of 64×64 dots, the font pattern (IFNTP) of each font has 512 bytes. A maximum of 10 icon fonts can be defined per object.

Figure 8:
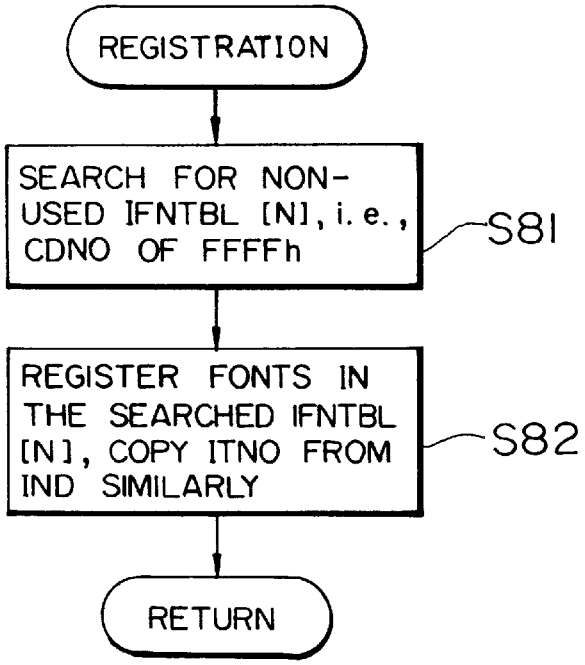
FIG. 8 is a flowchart showing the process of registering a plurality of icon fonts.

FIG. 8 is a flowchart showing the process of registering icon fonts executed by CPU 21.

First, in step S81, an area whose presently displayed icon no (CDNO) in the one unit (IFNTREC) of the icon display data table (IFNTBL) is FFFFh (h indicates a hexadecimal number) is searched for. The presently displayed icon no. (CDNO) having FFFFh indicates a non-used area.

Next, in step S82, the value in the number of icon fonts (ITNO) and the value in the font pattern (IFNTP) of the registration parameter (IFNTREC) are respectively stored in the areas of the number of registered fonts (ITNO) and the registered fonts (IFNTREG) in the searched one unit (IFNTREC). Also, the position of the searched one unit (IFNTREC) in the icon display data table (IFNTBL) is set as the object identifier (OBJNO) which is the return data, by which the process is ended.

Figure 9:
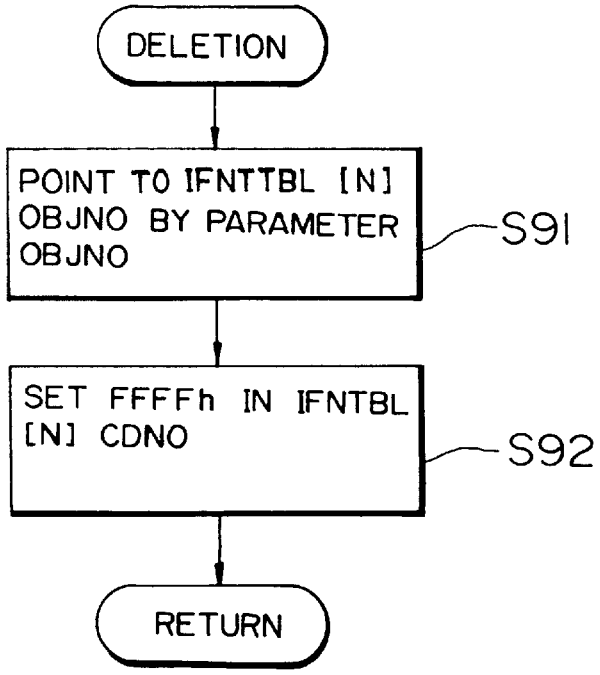
FIG. 9 is a flowchart showing the process of erasing a plurality of icon fonts.

FIG. 9 is a flowchart showing the process of deleting the icon fonts executed by CPU 21.

In step S91, the one unit (ICONREC) in the icon display data table (IFNTBL) is pointed to on the basis of the object identifier (OBJNO) which is an input parameter. In step S92, FFFFh (a deleting symbol) is set in the presently displayed icon no. (CNDO) in the pointed to ICONREC.

Figure 10:
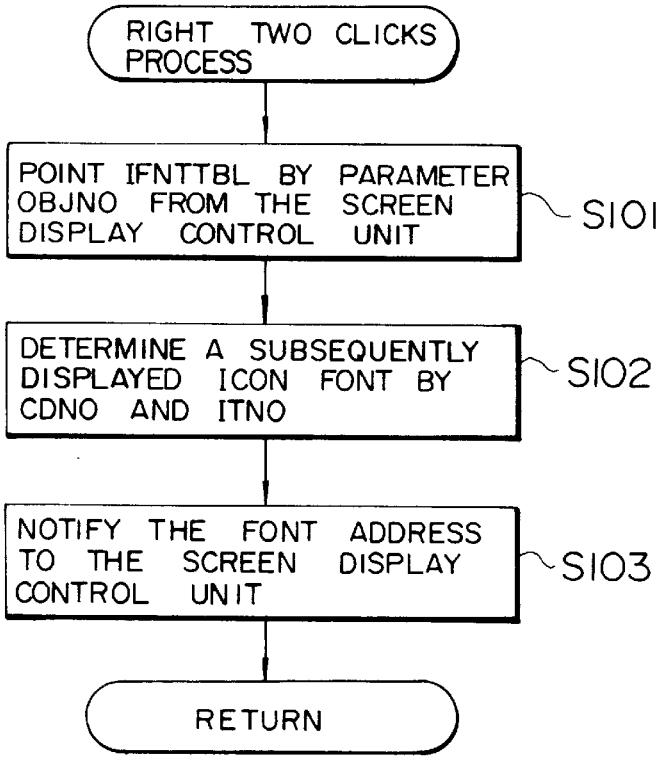
FIG. 10 is a flowchart showing the process of displaying a subsequent icon font.

FIG. 10 is a flowchart showing the process of displaying a subsequent icon font. This process is activated by the screen display control unit (SCNT) using the object identifier (OBJNO) as a parameter when the right button of the mouse is clicked twice.

First, in step S101, the one unit (ICONREC) in the icon display data table (IFNTBL) is pointed out on the basis of the object identifier (OBJNO). In step S102, the value with "1" added to the presently displayed icon no. (CDNO) is compared with the value stored in the number of registered fonts (ITNO). If the value with "1" added to the presently displayed icon no. (CDNO) is larger than the value in the number of registered fonts (ITNO), "0" is set in the presently displayed icon no. (CNDO).

Next, in step S103, a subsequently displayed font address is calculated on the basis of the presently displayed icon no. (CDNO), the size of IFNTREC and the starting address of the icon display data table (IFNTBL), by which the process returns.

Since the value in the presently displayed icon no. (CDNO) is FFFFh when registration is performed, "1" is added to the presently displayed icon no. (CDNO) in step S102. This allows the common routine shown in FIG. 10 to be used for both an initial display made after initial registration and the subsequent icon font display.

Furthermore, in this embodiment, the 50 areas of the presently displayed icon no. (CDNO) are initialized to FFFFh when the apparatus is switched on.

As mentioned above, in the present embodiment, display of a plurality of icon fonts for one object at the same display position is made possible by both the function of registering a plurality of icon fonts and the function of recognizing the request for display of a subsequent icon.

Therefore, even when only a single icon font is displayed to express a single object, the operator can be informed of the significance of the object. Consequently, the efficiency of the operator and the user interface function can be improved.

In this embodiment, a personal computer has been described. However, the present invention can also be applied to, for example, a work station or a terminal device.

Application of the present invention to a work station can be achieved by the use of the same configuration as that of this embodiment, shown in FIGS. 1 and 2. To implement a terminal device, the application program (APROG) shown in FIG. 1 is provided on a host computer, and the terminal device has, in place of the application program shown in FIG. 1, a "function of communicating with the host computer", which communicates with the host computer "the parameter (IFNTPRM) shown in FIG. 7" and "the object identifier (OBJNO) and display address". Hence, a host communication interface for communicating with the host computer is added to the structure shown in FIG. 2.

Furthermore, in this embodiment, the maximum number of icon fonts that can be registered is limited to 10. However, the limitation of the number of icon fonts that can be registered can be removed by making the size of the one unit (IFNTREC) in the icon display data table (IFNTBL) variable.

Furthermore, an object management, which replaces the application program shown in FIG. 1, may control a plurality of application programs at the same time to manage the object identifier and the icon display address in the same manner as that of this embodiment.

Furthermore, if a multiwindow-oriented screen display control unit (SCNT) or object management is provided, the subsequent icon font display function can be implemented on the multi-window as well without changing the icon display control (ICONT) function which characterizes the present invention. A multiwindow-oriented work station or terminal machine can also achieve the function of displaying a subsequent icon font.

In this embodiment, the font size is 512 bytes (64×64 dots). However, the font size is not fixed and can be changed freely in both width and height. In that case, the layout of the one unit (IFNTREC) in the icon display data table (IFNTBL), the layout of the registered parameter (IFNTPRM), and the processing contents of the screen display control unit (SCNT) and icon display control (ICNT) must be changed accordingly. These functions can be done easily.

Further, display of a subsequent icon is performed when the right button of a mouse is clicked twice. However, it may also be initiated by the operation of keys on a keyboard or by touching of a touch panel provided on a display.

Figure 6:
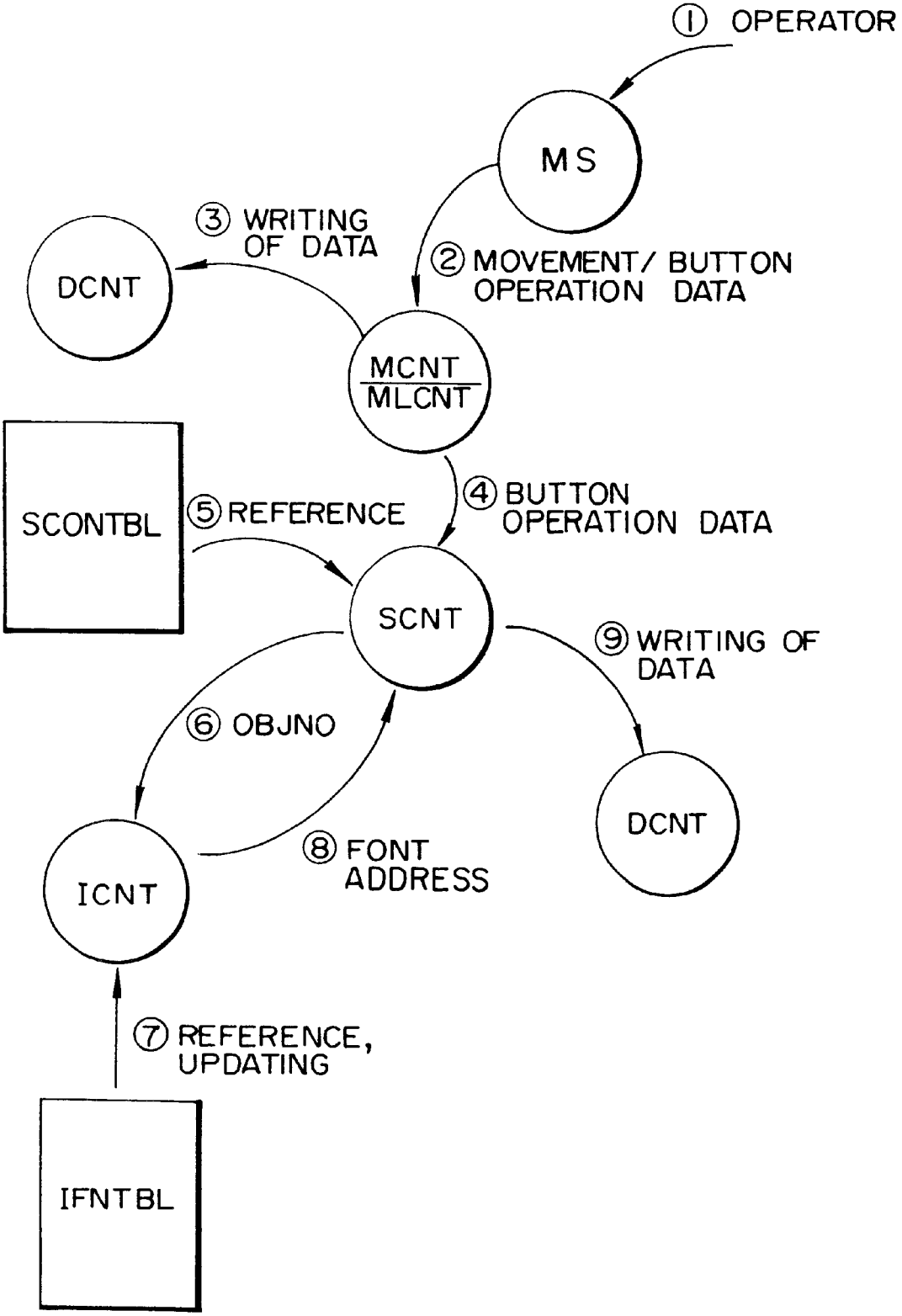
FIG. 6 is a transition diagram showing the control operations of displaying a subsequent icon font.

Furthermore, an area in which font addresses in the IFNTBL are stored may be provided in the SCONREC shown in FIG. 4 so as to allow the screen display control unit (SCNT) to store the font addresses shown in FIGS. 5 and 6 in the SCONREC. In this way, the processing speed of the overall screen display or the like can be increased.

The present invention can be applied to either an apparatus made up of a single component or a system made up of a plurality of components. The present invention can also be applied to an apparatus or a system which is activated when the program is supplied thereto.

As will be understood from the foregoing description, in the present invention, since a single object can be expressed by a plurality of icons, operability and workability can be enhanced.

A second embodiment of the present invention will be described below with reference FIGS. 1 and 3 through 11. The description of FIGS. 1 and 3 through 10 has already been provided with respect to the first embodiment and will be omitted.

Figure 11:
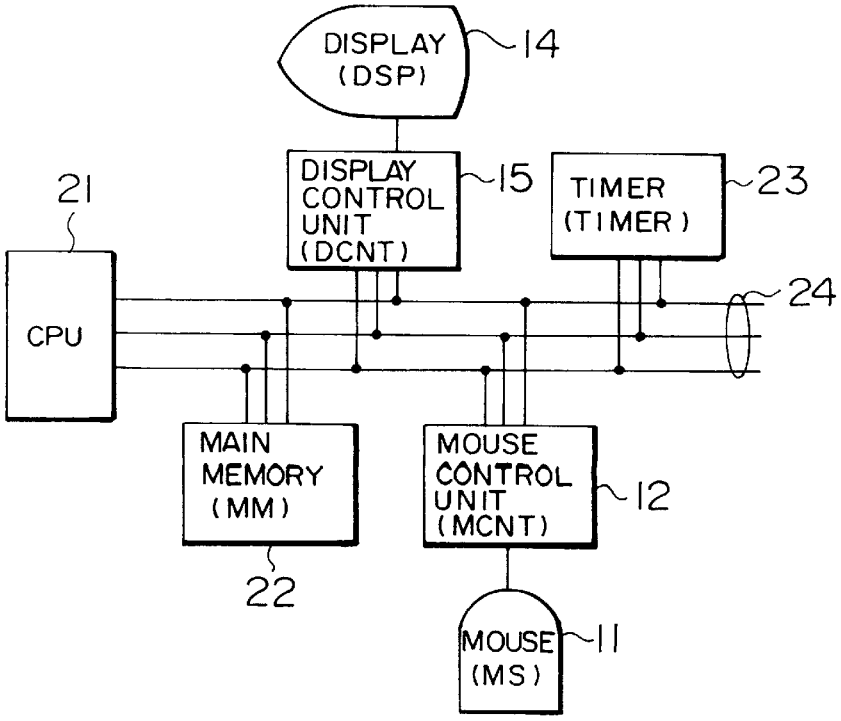
FIG. 11 illustrates another hardware structure of the personal computer shown in FIG. 1.

FIG. 11 is a view illustrating the hardware of the block diagram of FIG. 1 in the second embodiment. FIG. 11 shows a personal computer. In FIG. 11, a microprocessor (CPU) controls the entire personal computer according to the control procedures (programs) shown in FIGS. 8 through 10, which have been described with respect to the first embodiment, and control data. A main memory (MM) 22 stores the mouse display control unit 13, the screen display control unit 16, the icon display control unit 17, the application program 18, the icon display data table 19, the screen control data table 20, the control procedures program and so on. A timer 23 counts a predetermined time interval when the registered icon font is displayed. A CPU bus 24 consists of an address bus, a data bus and control lines.

In this embodiment, the screen display control unit (SCNT) writes all the icon fonts corresponding to the object in the icon display data table (IFNTBL) managed by the icon display control unit (ICNT) at the corresponding address in the display control unit (DCNT) so as to display them on the display (DSP) at predetermined time intervals. The aforementioned time intervals are 1.5 second in this embodiment. This time is counted by the timer (TIMER) shown in FIG. 11 so as to allow the screen display control unit (SCNT) to be activated.

Consequently, all the icon fonts registered for the object are displayed on the display (DSP) at time intervals of 1.5 second. 1.5 second after the display of the final icon font, the icon display area (of 64×64 dots) on the display (DSP) is cleared. This lasts for 1.5 second. Thereafter, the first icon is displayed again.

In this embodiment, the registered icon fonts are sequentially displayed at time intervals of 1.5 second. However, it may be arranged such that the time during which each icon font is displayed is changed by the user.

As described with respect to the first embodiment, and the invention of the second embodiment the present invention can be applied to either an apparatus made up of a single component or a system made up of a plurality of components. The present invention can also be applied to an apparatus or a system which is activated when the program is supplied thereto.

As will be understood from the foregoing description, since a plurality of icons registered for a single object can be displayed at predetermined time intervals, operability and workability can be enhanced.

A third embodiment of the present invention will be described below with reference to FIGS. 1 through 10 and FIGS. 12 through 14. The description of FIGS. 1 through 10 has already been provided with respect to the first embodiment and will be omitted.

Control of display of the presently displayed/subsequently displayed icon fonts will be described below with reference to FIGS. 12 through 14.

Figures 12, 13, 14:
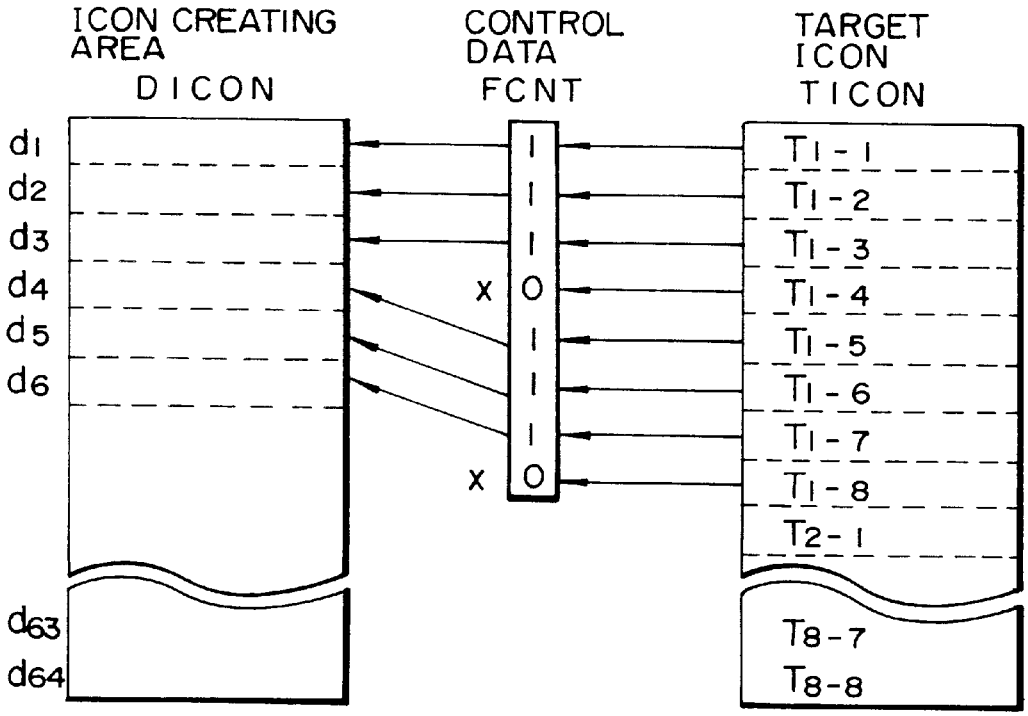
FIG. 12 is a view explaining the selection process carried out in still another embodiment of the present invention.
FIG. 13 illustrates control data used in the selection process.
FIG. 14 illustrates the starting addresses of an icon creating area.

FIG. 12 illustrates the process executed by the screen display control unit (SCONT) when display is switched over from the presently displayed icon to the subsequently displayed icon to select the presently displayed/subsequently displayed icon {hereinafter referred to as a target icon (TICON)} according to control data (FCNT) and then to store the selected target icon in an icon creating area (DICON).

As shown in FIG. 12, the target icon (TICON) consists of $T_{1-1}$ through $T_{1-8}$ and $T_{2-1}$ through $T_{2-8}$, . . . , $T_{8-1}$ through $T_{8-8}$. Each has 64 bits which is one unit of the present/subsequent icon font. The control data (FCNT) is used for selecting the icon fonts $T_{1-1}$ through $T_{8-8}$. The control data (FCNT) consists of 8 data items. If the contents of the data item of the control data are "1", selection of $T_{1-1}$ through $T_{8-8}$ is made and the selected bit is set in the icon creating area (DICON). If the contents of the data item are "0", selection of $T_{1-1}$ through $T_{8-8}$ is not made.

The icon creating area (DICON) consists of $d_1, d_2, \ldots, d_{64}$, each of which has 64 bits. The data selected by the control data (FCNT) are set in the icon creating area in sequence starting with $d_1$.

Arrows in FIG. 12 indicate that one unit of the target icon (TICON) is selected by the control data (FCNT) and that the selected target icon is set in the icon creating area (DICON). In other words, when the control data (FCNT) is "0", one unit of the target icon (TICON) is not set in the icon creating area (DICON) and is discarded.

FIG. 13 illustrates a set of control data (FCNT) shown in FIG. 12. In FIG. 13, $f_1$ is the control data which indicates 7/8 display of an icon, $f_2$ indicates 6/8 display of an icon, . . . , $f_7$ indicates 1/8 display of an icon. To sequentially reduce the present icon in the direction of the height thereof, $f_1, f_2, , f_7$ are sequentially set in the control data (FCNT) in that order. To enlarge the subsequent icon sequentially, $f_7, f_6, \ldots, f_1$ are sequentially set in the control data (FCNT) in that order.

FIG. 14 shows data which designates the starting position of the icon creating area (DICON). To simplify the description, it has been described in connection with FIG. 12 that data is set in the icon creating area (DICON) from $d_1$. However, in an actual operation, $S_1$ is used when $f_1$ is used in the control data (FCNT), $S_2$ is used for $f_2$, and so on, to change the setting position in the icon creating area (DICON).

In this way, when the presently displayed icon is switched to the subsequently displayed icon, it can be displayed as if a card is turned over.

In this embodiment, each icon has a size of 64×64 bits. It is not reduced in the direction of width but is reduced in the direction of height. However, the icon may be divided into 8 portions in the direction of height so that the divided $T_1$ ($T_1$ through $T_{1-8}$), $T_2$ ($T_{2-1}$ through $T_{2-8}$), . . . , $T_8$ ($T_{8-1}$ through $T_{8-8}$) of the target icon (TICON) are selected by the same control data (FCNT).

As mentioned above, in the present embodiment, display of a plurality of icon fonts for one object at the same display position is made possible by both the function of registering a plurality of icon fonts and the function of recognizing the request of display of a subsequent icon.

Therefore, even when only a single icon font can be displayed to express a single object, the operator can know the significance of the object. Consequently, the efficiency of the operator and the user interface function can be improved.

In the third embodiment, the icon is reduced and enlarged in the direction of the height thereof. However, an icon may also be reduced and enlarged in the direction of the width thereof using the data shown in FIGS. 13 and 14.

The invention of the third embodiment can also be applied to either an apparatus made up of a single component or a system made up of a plurality of components. The present invention can also be applied to an apparatus or a system which is activated when the program is supplied thereto.

As will be understood from the foregoing description, in the present invention, a single object is expressed by a plurality of icons, and the presently displayed icon and the subsequently displayed icon have a relation similar to the two sides of a card so that display of the icon is switched over by turning over the presently displayed one. Consequently, operability and workability can be enhanced.

According to a fourth embodiment of the invention, a plurality of icon patterns can be registered for a single function, and these registered plurality of icon patterns are stored according to the function. When an instruction of switch over the presently displayed icon pattern to another icon pattern is given, the present icon pattern display is switched over to that of a subsequent icon pattern.

The fourth embodiment of the present invention will be described below in detail with reference to the accompanying drawings.

Figure 15:
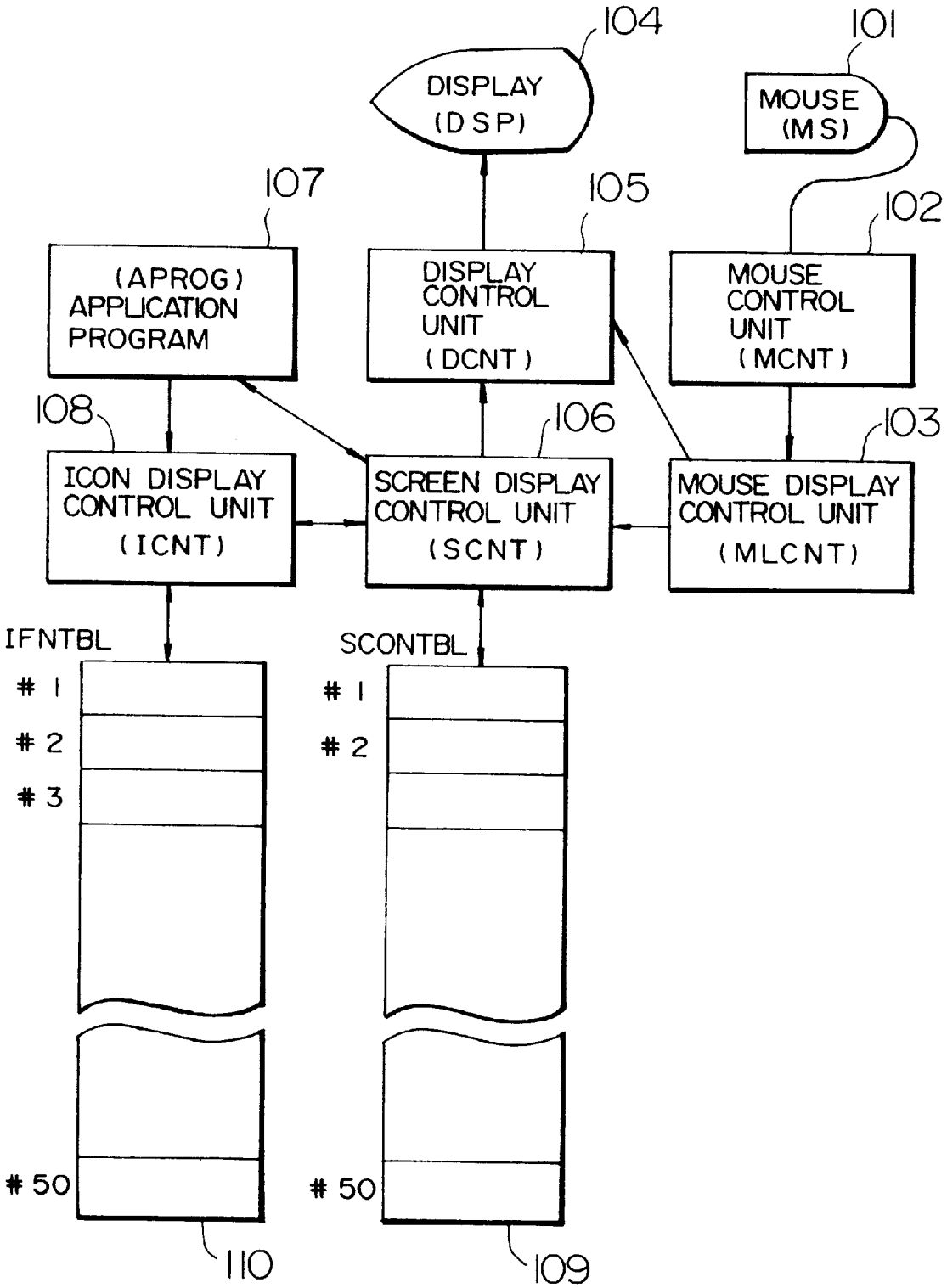
FIG. 15 is a block diagram of a display control device, showing still another embodiment of the present invention.

FIG. 15 is a block diagram, illustrating the structure of the display control apparatus according to the present invention. A mouse 101 is a pointing device. A mouse control unit 102 receives an electric signal representing a relative movement from the mouse 101, converts the electric signal into a distance through which the mouse has been moved and outputs the resultant distance. A mouse display control unit 103 inputs the signal representing the moved distance from the mouse control unit 102, and displays the cursor according to the distance through which the mouse 101 has been moved. A display 104 is a CRT in this embodiment. A display control unit 105 has, for example, a CRT controller (CRTC), and performs display control in terms of the hardware. A screen display control unit 106 receives image data whose display is requested and converts the received data into a video signal to be input to the display 104. An icon display control unit 108 displays a predetermined icon selected from among a plurality of registered icons or registers or deletes the icons according to the instruction from the screen display control unit 106. An application program unit 107 performs screen display, icon font registration and so on.

A screen control data unit 109, managed by the screen control unit 106, stores a screen display state including the icon display control data. In this embodiment, display control of 50 types of objects is performed. An icon display data 110, managed by the icon display control unit 108, stores font data for icon display and control data therefor. In this embodiment, 50 types of icons can be displayed, and 10 fonts can be registered for each type.

Figure 16:
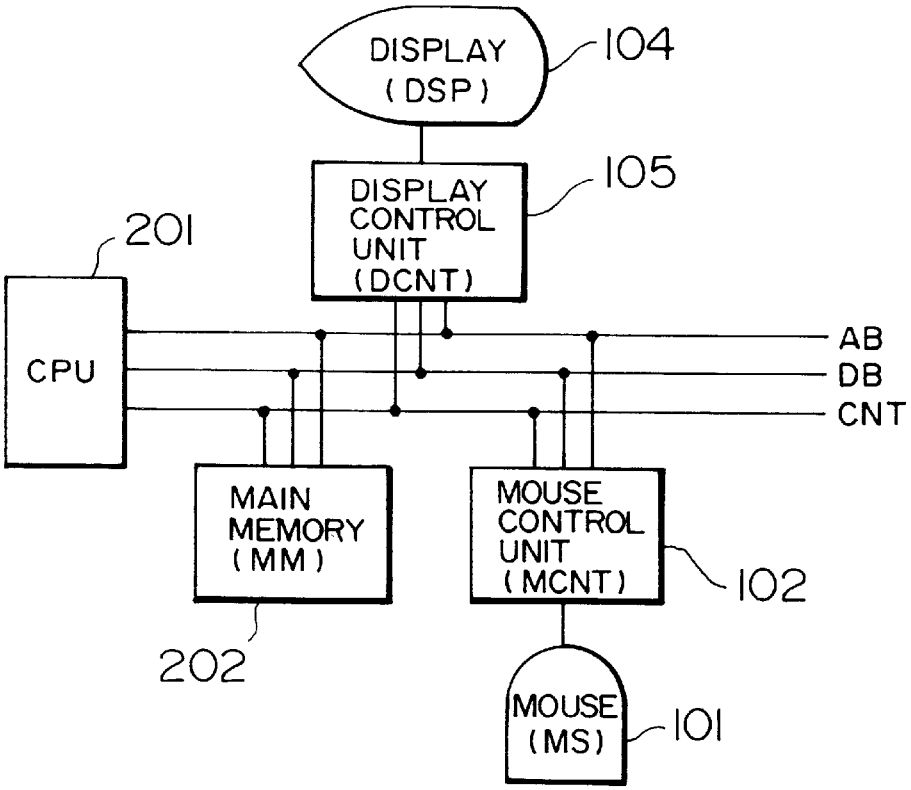
FIG. 16 is a block diagram of a control unit of the display control device of FIG. 15.

FIG. 16 is a block diagram showing the structure of a control unit of the display control apparatus shown in FIG. 15. In FIG. 16, the same reference numerals are used to denote parts corresponding to those of FIG. 15. FIG. 16 shows an example of a personal computer.

A CPU 201 is, for example, a microprocessor. A main memory 202 stores the control programs of the CPU 201 which execute the functions of the mouse display control unit 103, the screen display control unit 106 and the icon display control unit 108, the application program unit 107, the icon display data unit 110, the screen control data unit 109, and so on. Reference symbols AB, DB and CNT respectively denote an address bus, a data bus and a control data bus.

Figure 17:
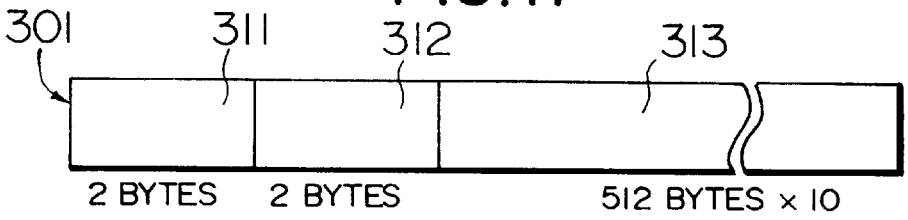
FIG. 17 illustrates the format of icon data in an icon display data unit which manages a single object.

FIG. 17 shows the data format of the icon display data shown in FIG. 15. In FIG. 17, 301 indicates the entirety of the area in which the icon data on the single object is stored.

In FIG. 17, 311 is an area which indicates the presently displayed icon no., and has 2 bytes. 312 is an area in which a number of fonts currently registered for one type of object is stored. 313 is an area in which the registered fonts are stored. In the registered font area, 512 bytes are allocated to a single type of icon font data, and 5120 bytes are allocated so that a maximum of 10 types of icon font data can be stored therein.

Figure 18:
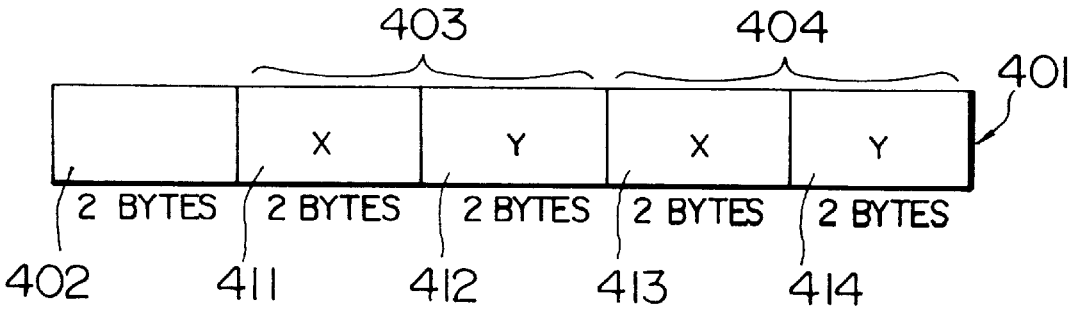
FIG. 18 illustrates the format of screen control data in a screen control data unit which manages a single object.

FIG. 18 illustrates the data format of the screen control data unit 109.

In FIG. 18, 401 indicates an area in which data on a single object is stored.

402 indicates an area in which data used to identify an object is stored. The area 402 has 2 bytes. 403 is an area in which data representing the left upper coordinate position of the icon when the icon is displayed on the display 104 is stored. In the area 403, the addresses in both X and Y axes, each having 2 bytes, are stored in a 4 byte-area. 404 is an area in which data representing the right lower coordinate position of the icon when the icon is displayed on the display 104 is stored. In the area 403, the addresses in both X and Y axes, each having 2 bytes, are stored in a 4 byte-area.

Registration of a plurality of icons for one object, deletion of the icons and sequential display of the plurality of icons representing one object will be described below with reference to the related figures.

Figure 19:
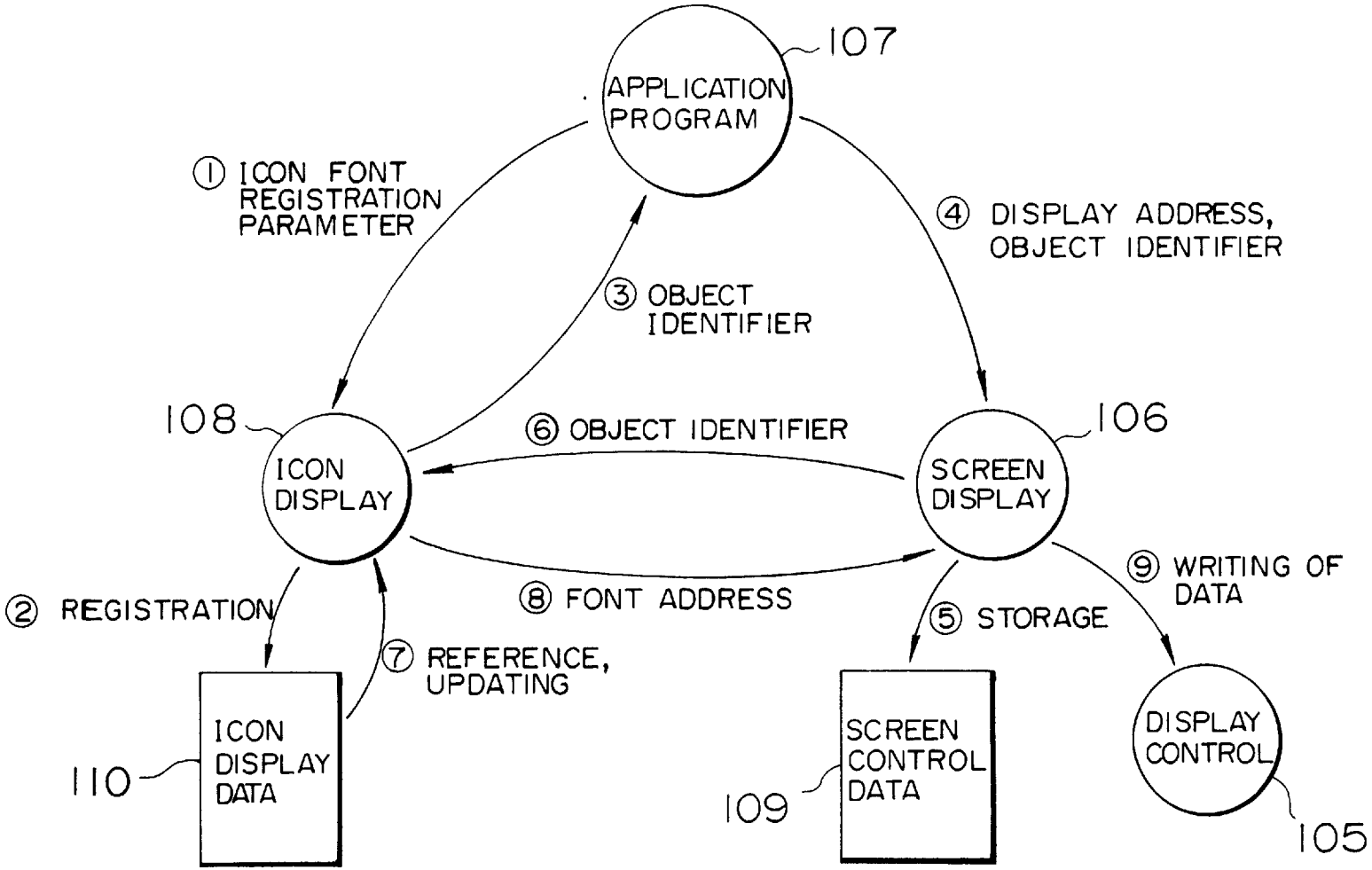
FIG. 19 is a transition diagram of the control operations when a plurality of icon fonts are registered.

FIG. 19 is a control transition diagram illustrating the control operations of registering and displaying a plurality of icon fonts for one object.

(1) An icon font registration parameter, which will be described in detail later, is handed from the application program unit 107 to the icon display control unit 108.

(2) The icon display control unit 108 processes the icon font registration parameter received from the application program unit 107 and stores the processed data in the icon display data unit 110.

(3) The icon display control unit 108 informs the application program unit 107 of the stored position in the icon display data unit 110 as the object identifier.

(4) The application program unit 107 hands the left upper address of the icon font on the display 104 and the object identifier to the screen display control unit 106, and thereby requests an initial icon display of the registered object.

(5) The screen display control unit 106 stores both the object identifier and the display address in the screen control data unit 109

(6) The screen display control unit 106 hands the object identifier to the icon display control unit 108 and thereby requests the address of the icon font of the corresponding object.

(7) The icon display control unit 108 detects the font address corresponding to the object by referring to the icon display data unit 110 on the basis of the received object identifier, and then (8) lets the screen display control unit 106 know the detected font address.

(9) The screen display control unit 106 writes the icon font at the display address in the display control unit 105 corresponding to the display address on the display 104, so that the icon is displayed on the display 104.

Prior to description of icon display switch over which is achieved by the operation of a mouse, various operations of the mouse button and the corresponding functions will be described first. In this embodiment, a two-button mouse is used for the following operations.

1. One click of the left button: positive instruction
2. Two clicks of the left button: execution of the object
3. One click of the right button: negative instruction
4. Two clicks of the right button: display of a subsequent font of the icon The mouse operations of Items 1, 2 and 3, which are respectively processed by the mouse control unit 102, the mouse display control unit 103 and the screen display control unit 106 in this embodiment, have no direct relation to the present invention and description thereof is omitted.

The control operations when the right button is clicked twice will be described below with reference to FIG. 20.

(1) and (2) When the operator (user) operates the mouse 101, the mouse display control unit 103 detects the contents of that operation through the mouse control unit 102. If the contents of the operation are to move the mouse, the mouse display control unit 103 writes the data on the mouse 101 in the display control unit 105 to display the icon representing the mouse 101 (or a cursor) on the display 104 according to the movement (3).

(4) If the data from the mouse control unit 102 indicates the button operation, the mouse display control unit 103 notifies the screen display unit 106 of both the physical address (X and Y coordinate values) of the cursor on the display 104 and the contents of the button operation (right/left button and one/two clicks).

(5) The screen display control unit 106 executes the process corresponding to the contents of the button operation of the mouse 101. The single or double clicks of the left button and the single click of the right button have no direct relation to the present invention and the description thereof is omitted. If the right button is clicked twice, the screen display control unit 106, knowing that it indicates a request of display of a subsequent icon font, determines whether the X and Y coordinate values given by the mouse display control unit 103 are within a square defined by the left upper display address 403 and the right lower display address 404 (FIG. 4) in one unit of the screen control data unit 109 . If the corresponding screen control data is detected, the object identifier 402 of that object is read out.

(6) The screen display control unit 106 hands the detected object identifier to the icon display control unit 108 and thereby requests the address of an icon font to be displayed subsequently.

(7) The icon display control unit 108 detects the font address corresponding to the object identifier by referring to the icon display data unit 110, and then lets the screen display control unit 106 know of the detected font address (8).

(9) The screen display control unit 106 controls switch over of the present and subsequent icon fonts on the display 104 by making a continuous card on which the presently displayed icon font and the subsequently displayed icon font are slid in the display window having the size of one card. Hence, the screen display control unit 106 writes the data obtained by combining suitable portions of the two icon fonts at the corresponding address on the display control unit 105 so as to display it on the display 104 (how the data is written will be described later with reference to FIG. 25).

In the processes executed by the mouse control unit 102, the mouse display control unit 103, the display control unit 105, the processes other than those of registering a plurality of icon fonts and of displaying the subsequent icon font are known and description thereof is omitted.

The process executed by the icon display control unit 108 for registration and deletion of a plurality of icon fonts and for display of a subsequent icon font will be described below with reference to FIGS. 22 through 25.

Figure 21:
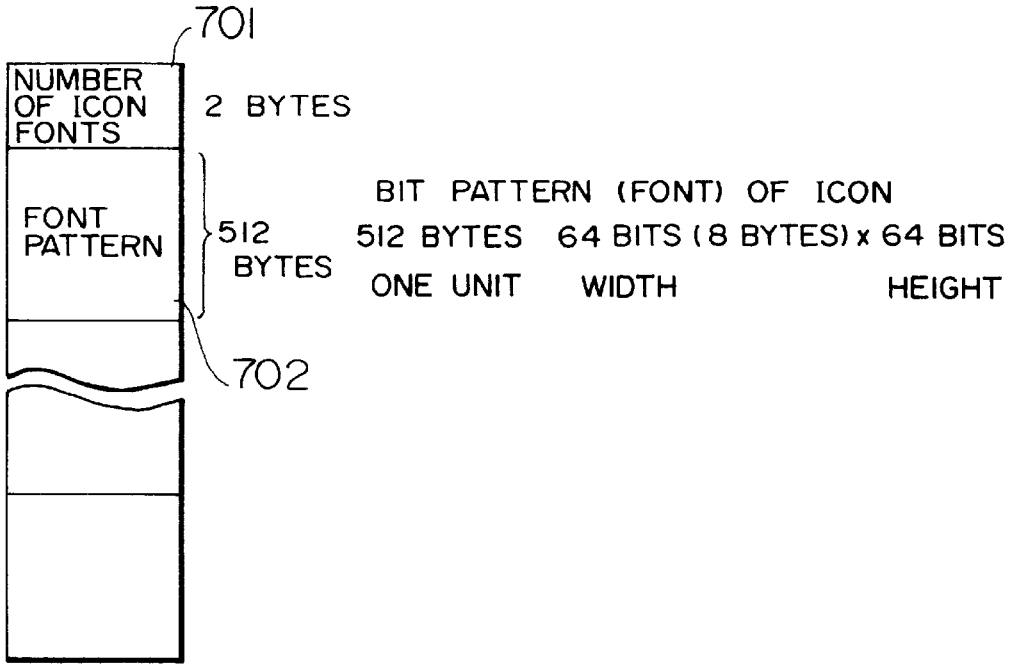
FIG. 21 illustrates the format of a memory in which the plurality of icon fonts are registered.

FIG. 21 illustrates the contents of the icon font registration parameter when the application program unit 107 registers a plurality of icon fonts for a single object.

As shown in FIG. 21, the parameter is made up of a number of icon fonts 701 and a font pattern 702. The number of icon fonts 701 is an area in which the number of registered font patterns is indicated, and has 2 bytes. In this embodiment, since the icon font is designed to have a bit pattern of 64×64 dots, the font pattern of each font has 512 bytes. A maximum of 10 icon fonts can be defined per one type of icon.

The process executed by the icon display control unit 108 for registration, deletion and display of a subsequent icon font will be described below with reference to FIGS. 22 through 25.

Figure 22:
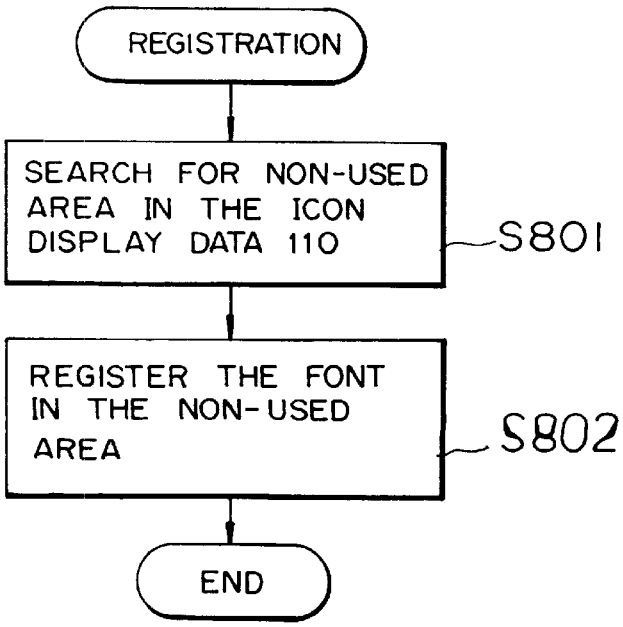
FIG. 22 is a flowchart showing the process of registering icon fonts.

FIG. 22 is a flowchart showing the process of registering icon fonts.

First, in step S801, an area whose icon no. 311 of the icon data 301 in the icon display data 110 is FFFFh (h indicates a hexadecimal number) is searched for. The icon no. 311 having FFFFh indicates a non-used area. Next, in step S802, the value in the number of icon fonts 701 and the value in the font pattern 702 shown in FIG. 21 are respectively stored in the areas of the number of registered fonts 312 and registered fonts 313 in the searched icon data. Also, the position of the searched icon data in the icon display data 110 is set as the object identifier which is the return data, by which the process is ended.

Figure 23:
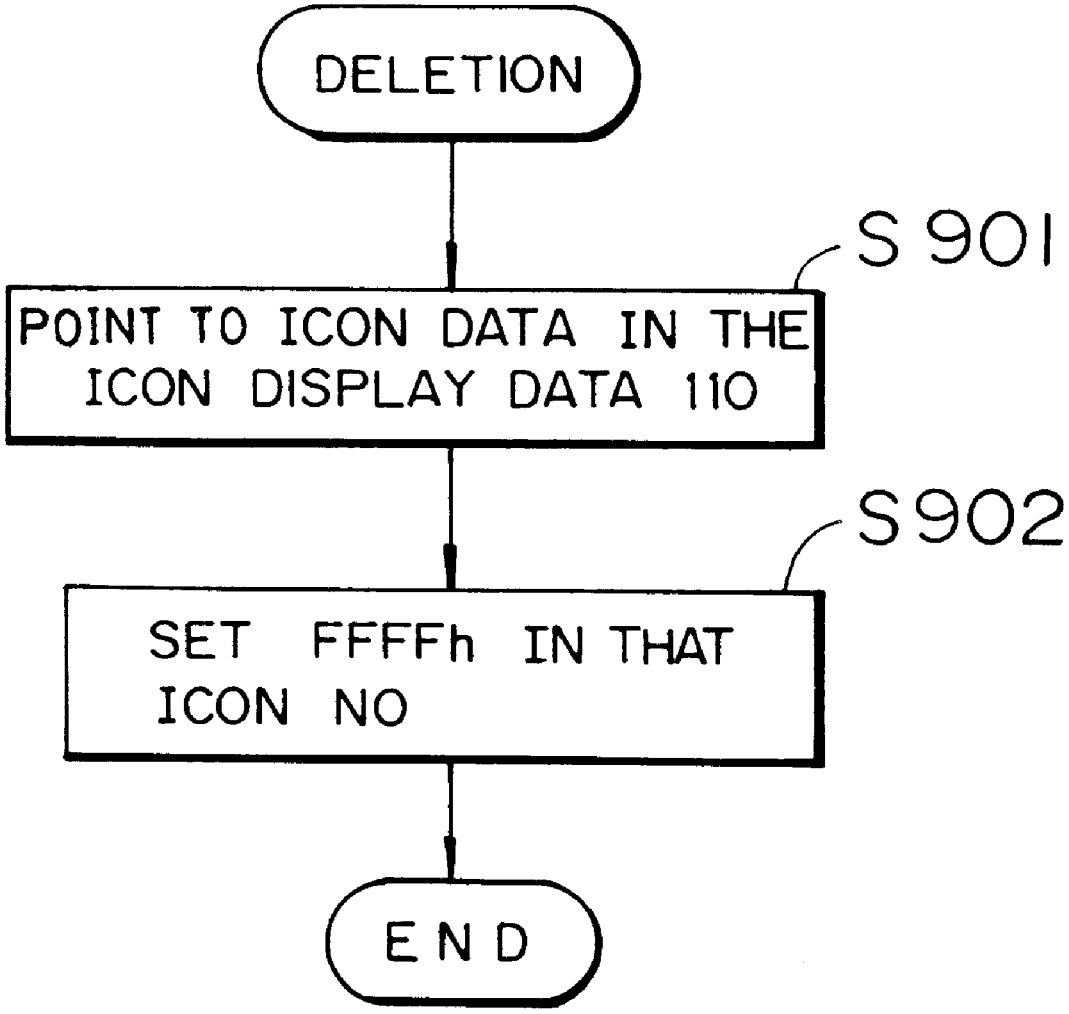
FIG. 23 is a flowchart showing the process of erasing the icon fonts.

FIG. 23 is a flowchart showing the process executed by the icon display control unit 108 to delete the icon fonts.

In step S901, the icon data in the icon display data 110 is pointed on the basis of the object identifier which is an input parameter. In step S902, FFFFh (a deleting symbol) is set in the icon no. 311 of the pointed icon data.

Figure 24:
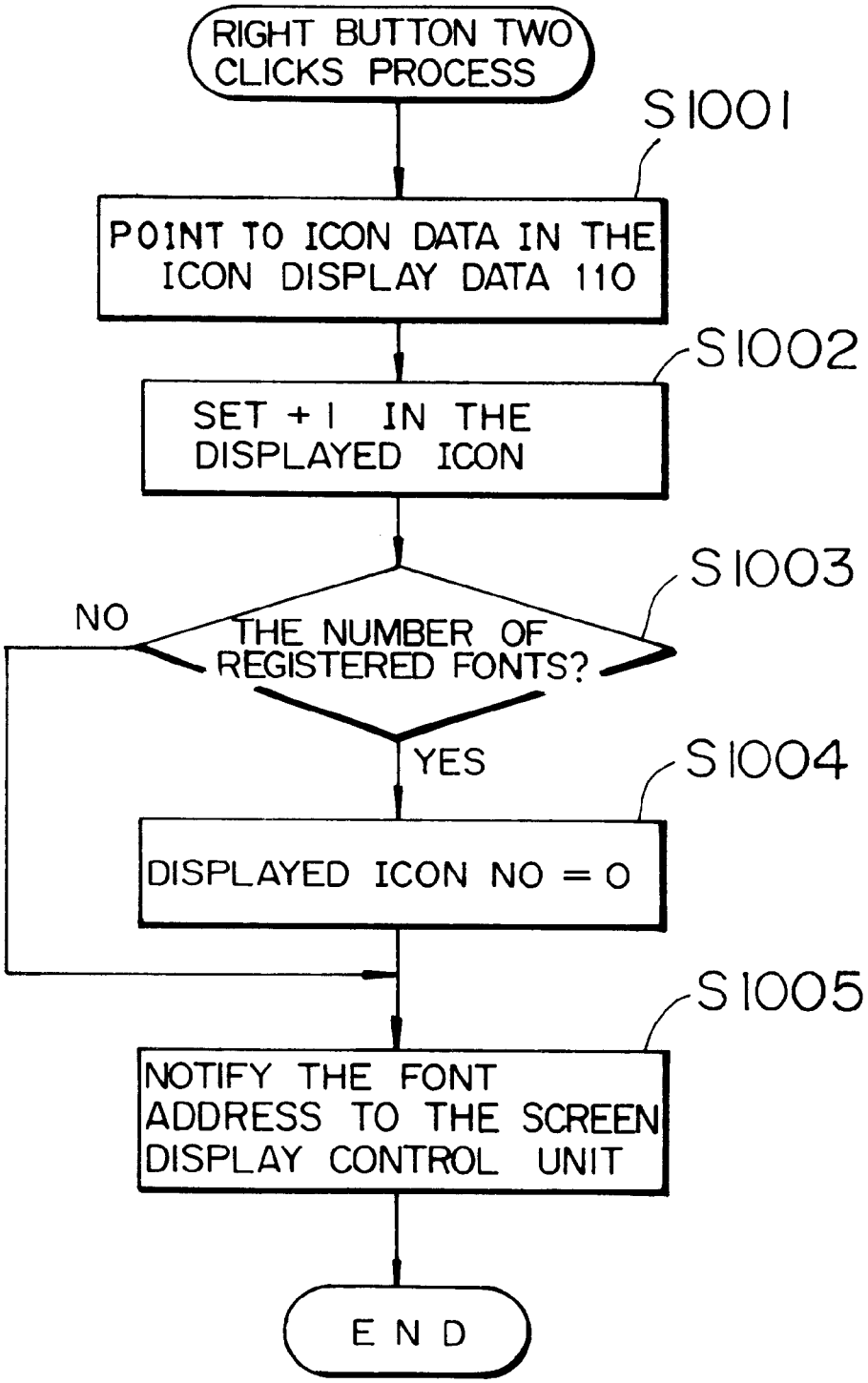
FIG. 24 is a flowchart showing the process of displaying a subsequent icon font.

FIG. 24 is a flowchart showing the process executed by the icon display control unit 108 to display a subsequent icon font. This process is activated by the screen display control unit 106 using the object identifier as a parameter when the right button of the mouse is clicked twice.

First, in step S1001, the icon data 301 in the icon display data 110 is pointed out on the basis of the object identifier. In step S1002, "1" is added to the icon no. 311 of the pointed icon data 301, and the resultant value is compared with the value stored in the number of registered fonts 312 in step S1003. If the value with "1" added to the icon no. is larger, "0" is set in the displayed icon no. 311 in step S1004.

In step S1005, a subsequently displayed font address is calculated on the basis of the displayed icon no. 311, the size of the icon data and the starting address in the icon display data unit 110, by which the process returns.

Since the value in the icon no. 311 is FFFFh when registration is made, "1" is always added to the icon no. 311 in step S1002. This allows the common routine shown in FIG. 24 to be used for both initial display made after initial registration and the subsequent icon font display. Hence, in this embodiment, FFFFh is initially set in the 50 areas of the icon no. 311 when the apparatus is switched on.

Figure 25:
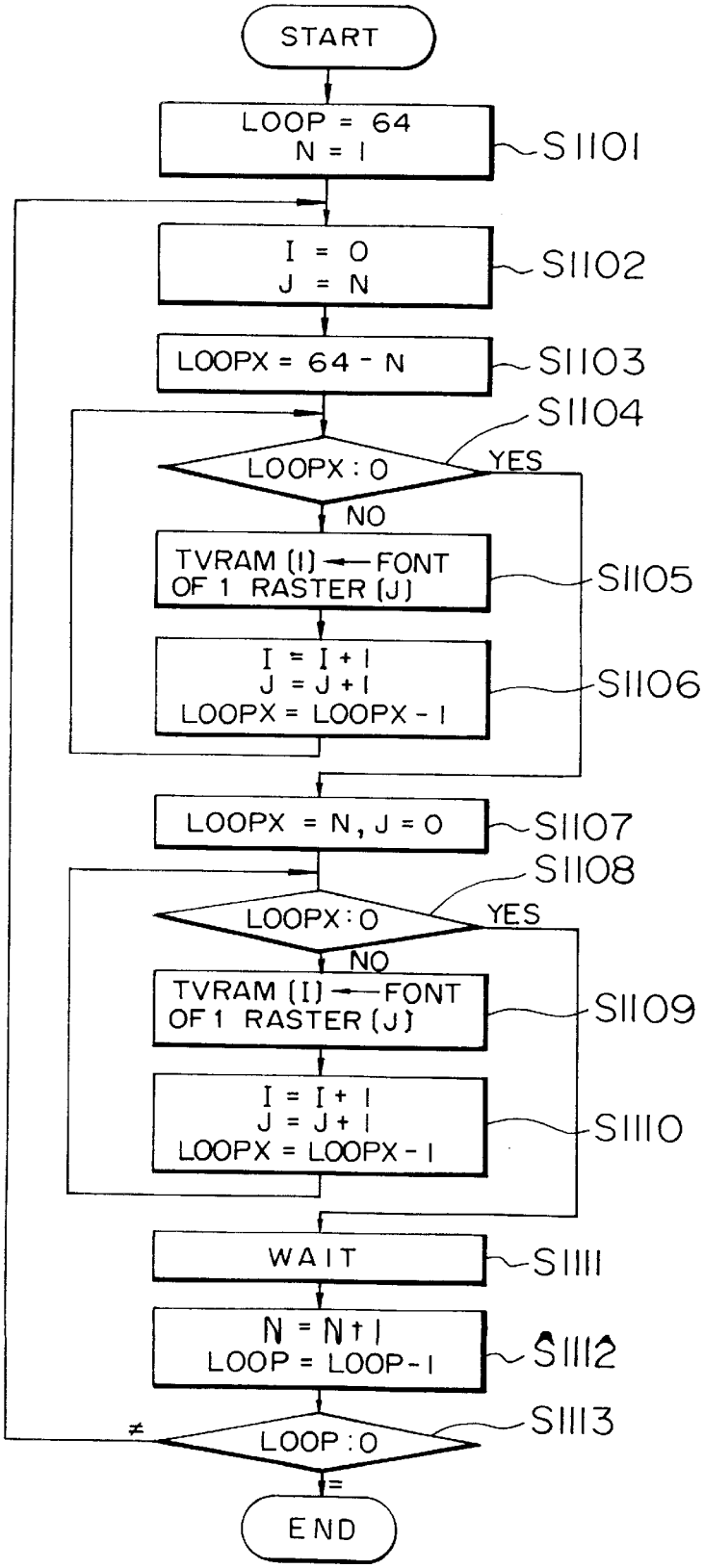
FIG. 25 is a flowchart showing the process of switching over an icon font display by scrolling when a subsequent icon font is displayed.

FIG. 25 is a flowchart of the process executed by the screen display control unit 106 to display on the display 104 through the display control unit 105 two icon fonts, the presently and subsequently displayed icon fonts, as if they are scrolled as one icon font.

First, in step S1101, initialization of the entire control is performed. In this embodiment, "64 is assigned to a variable LOOP as the value of controlling the number of rasters in the direction of the height of an icon, and "1" is assigned to a variable N to control the display ratio between the presently displayed font and the subsequently displayed font.

Next, in step S1102, "0" is assigned to a variable I to control the address in the display control unit 105 at which the presently displayed icon font/subsequently displayed icon font are written. Also, the value of N is assigned to a variable J to control which raster in the presently displayed icon ("0" is given to the uppermost raster) is transferred to the display control unit 105. In step S1103 to S1106, the presently displayed icon is stored in the display control unit 105 and thereby displayed on the display 104 in such a manner that it is gradually erased from the upper portion thereof. That is, in step S1103, a value obtained by subtracting the value of the variable N from the variable LOOP is assigned to a variable LOOPX. Hence, the value in the variable LOOPX is decremented from 63 to 62, . . . , 0. In step S1104, it is determined whether or not a font obtained by moving the presently displayed icon in the direction of the height thereof by one raster has been displayed. If the answer is yes, the process goes to step S1107. If the answer is no, the process of step S1105 is executed.

In step S1105, one raster of the icon font obtained by moving the presently displayed icon in the direction of the height thereof by one raster is transferred to the display area (TVRAM[1]) of the display control unit 105. In step S1106, "1" is assigned to both I and J, "1" is subtracted from the variable LOOPX, and the process goes to step S1104. In step S1107 to S1110, an icon font to be subsequently displayed is transferred to the display control unit 105 at an address subsequent to that of the presently displayed icon font and is thereby displayed on the display 104.

In step S1107, the value of the variable N is assigned to the variable LOOPX to control the number of rasters in the subsequently displayed icon font which are transferred to the display control unit 105. Also, "0" is assigned to the variable J. The variable J controls how many rasters of the subsequently displayed icon fonts are transferred to the display control unit 105 at the address subsequent to that of the presently displayed font icon.

In step S1108, it is determined whether or not all of the subsequently displayed icon is transferred. If the answer is yes, the process goes to step S1111. If the answer is no, the process of step S1109 is executed. In step S1109, one raster of an icon font obtained by moving the subsequently displayed icon by one raster in the direction of the height thereof is transferred to the display area (TVRAM[1]) of the icon font display control unit 105. Next, in step S1110, "1" is added to both I and J, "1" is subtracted from the variable LOOPX, and the process goes to step S1108.

In step S1111, the wait subroutine is called to allow the process to be suspended at that step for a predetermined period of time. Since the function of suspending the process for the predetermined period of time is known, description thereof is omitted. After the predetermined period of time has elapsed, the process goes to step S1112. In step S1112, "1" is added to the variable N, and "1" is subtracted from the variable LOOP.

In step S1113, it is determined whether or not the value of the variable LOOP is "0". "0" in the variable LOOP indicates that the presently displayed icon has been smoothly replaced by the subsequently displayed icon.

In this embodiment, the personal computer has been described. However, the present invention can also be applied to, for example, a work station or a terminal machine. To implement a terminal machine, the application program unit 107 shown in FIG. 15 is provided in a host computer, and the terminal machine has, in place of the application program shown in FIG. 15, a "function of communicating with the host computer", which communicates with the host computer "the font patterns shown in FIG. 21" and "the object identifier and display address". Hence, a host communication interface for communicating with the host computer is added to the structure shown in FIG. 16.

Furthermore, in this embodiment, the maximum number of icon fonts that can be registered is limited to 10. However, the limitation to the number of icon fonts that can be registered can be removed by making the size of the icon data in the icon display data variable.

Furthermore, an object management, which replaces the application program 107, may control a plurality of application programs at the same time so as to manage the object identifier and the icon display address in the same manner as that of this embodiment.

Furthermore, if a multiwindow-oriented screen display control unit 106 or object management is provided, the subsequent icon font display function can be implemented on the multi-window as well without changing the icon display control function which characterizes the present invention. A multiwindow-oriented work station or terminal machine can also achieve the function of displaying a subsequent icon font.

In this embodiment, the font size is 512 bytes (64×64 dots). However, the font size is not fixed.

Furthermore, display of a subsequent icon is performed when the right button of a mouse is clicked twice. However, it may also be initiated by the operation of keys on a keyboard or by touching of a touch panel provided on a display 104.

Figure 20:
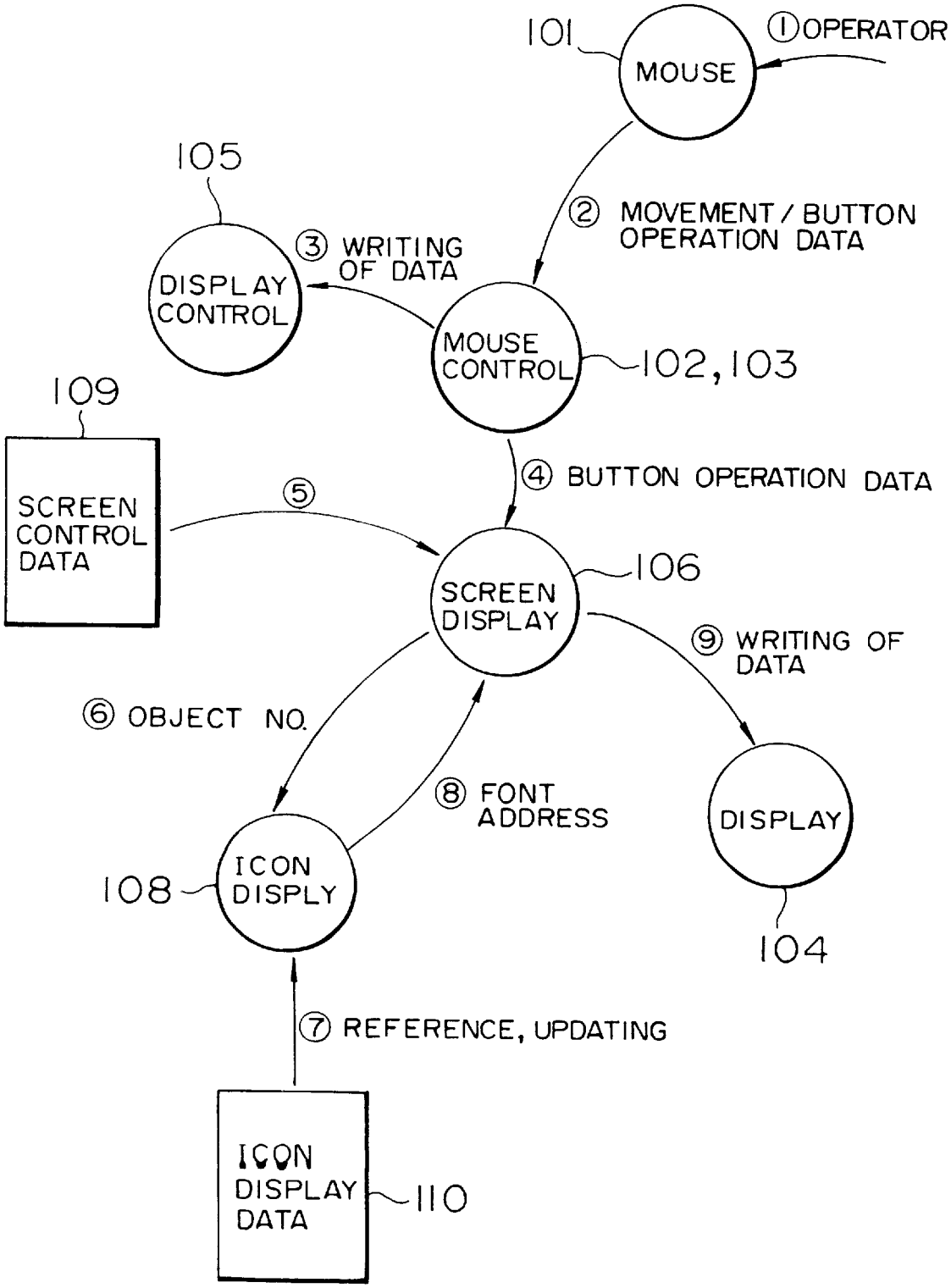
FIG. 20 is a transition diagram of the control operations of displaying a subsequent icon font.

Furthermore, an area in which font addresses stored in the icon display data unit 110 are stored may be provided in the screen control data 401 shown in FIG. 18 so as to allow the font addresses (8) shown in FIGS. 19 and 20 to be stored in the screen control data 401. In this way, the processing speed of the overall screen display or the like can be increased.

In the flowchart shown in FIG. 25, the presently displayed icon and the subsequently displayed icon are smoothly scrolled in the direction of the height thereof. However, they may also be scrolled in the direction of the width thereof.

In step S1104 through S1106 and S1107 through S1110 shown in FIG. 25, transfer of the font data is performed in the software. However, it may be processed by hardware (a hardware chip for transferring bits) for transferring the fonts.

The present invention can be applied to either an apparatus made up of a single component or a system made up of a plurality of components. The present invention can also be applied to an apparatus or a system which is activated when the program is supplied thereto.

As mentioned above, in the present embodiment, a plurality of icon fonts can be registered for one object, and the plurality of icon fonts can be displayed for one object by switching over icon display.

As will be understood from the foregoing description, in the present embodiment, a plurality of icon patterns can be registered for one object (or one function), and the object (or the function) can be explained using the plurality of icon patterns by switching over the icon pattern to be displayed to express the object (or the function).

What is claimed is:

1. A data processing apparatus for instructing an icon displayed on a display screen and thereby operating on an object corresponding to the instructed icon, comprising:

object storing means for storing an object;

icon storage means having a first area (31) and a second area (33) for storing an icon being assigned to the object;

administration means for storing a plurality of icon patterns in the second area and information relating to an icon pattern being displayed at present for the icon in the first area;

instruction means for instructing a first instruction or a second instruction;

decision means for deciding whether said instruction instructed by said instruction means is the first instruction or the second instruction;

replacing means for replacing the information stored in the first area when it is decided by said decision means that the first instruction is instructed by said instruction means;

display control means for displaying an icon pattern selected from the plurality of icon patterns stored in the second area based on the information stored in the first area on the display screen; and execution means for executing the object corresponding to the icon when it is decided by said decision means that the second instruction is instructed by said instruction means, wherein a number of said icon storage means equals to a number of objects stored in said object storage means.

2. A data processing apparatus according to claim 1, further comprising:

measuring means for measuring a time, wherein the icon being displayed every time a predetermined time is measured by said measuring means is changed to one of other plurality of icons when an instruction is given by said instruction means.

3. A data processing apparatus according to claim 2, wherein n icons are stored in said storage means, and the i-th icon is changed to the (i+1)-th icon every time a predetermined time is measured by said measuring means in accordance with an instruction by said instruction means.

4. A data processing apparatus according to claim 3, wherein when the n-th icon is displayed, the n-th icon is changed to the first icon.

5. A data processing apparatus according to claim 1, wherein said icon storing means has a third area for storing a number of the icon patterns, and further, said icon storing means has a replacing means for replacing a number of the icon patterns of said third area when a new icon pattern is stored in said second area.

6. A data processing apparatus according to claim 1, wherein said icon storing means has a third area for storing a number of the icon patterns, and further, said icon storing means has a replacing means of replacing a number of the icon patterns of said third area when a new icon pattern is stored in said second area.

7. A data processing apparatus for instructing an icon displayed on a display screen and thereby operating on an object corresponding to the instructed icon, comprising:

object storing means for storing an object;

icon storage means having a first area (31) and a second area (33) for storing an icon being assigned to the object;

instruction means for instructing a first instruction or a second instruction;

decision means for deciding whether said instruction instructed by said instruction means is the first instruction or the second instruction;

compression means for sequentially compressing pixel data of the icon stored in said storage means; and replacing means for replacing the information stored in said first area when it is decided by said decision means that the first instruction is instructed by said instruction means;

display control means for displaying an icon pattern selected from a plurality of icon patterns stored in said second area based on said information stored in said first area on the display screen; and execution means for executing the object corresponding to the icon when it is decided by said decision means that the second instruction is instructed by said instruction means;

wherein a number of said icon storage means equals to a number of objects stored in said object storage means.

8. A data processing apparatus according to claim 7, wherein said control means displays the i-th icon compressed in sequence by said compression means so as to reduce it in one direction and the (i+1)-th icon compressed in sequence by said compression means so as to expand it in the one direction.

9. A data processing apparatus according to claim 7, wherein when the n-th icon is displayed, the n-th icon is changed to the first icon.

10. A data processing apparatus according to claim 7, further comprising:

measuring means for measuring a time, wherein the icon being displayed every time a predetermined time is measured by said measuring means is changed to one of other plurality of icons when an instruction is given by said instruction means.

11. A data processing apparatus according to claim 10, wherein n icons are stored in said storage means, and the i-th icon is changed to the (i+1)-th icon every time a predetermined time is measured by said measuring means in accordance with an instruction by said instruction means.

12. A display control apparatus for instructing an icon displayed on a display screen and thereby executing one of a plurality of functions corresponding to the instructed icon, said apparatus comprising:

function storing means for storing a function;

icon storage means having a first area (31) and a second area (33) for storing an icon being assigned to the function;

instruction means for instructing a first instruction or a second instruction;

decision means for deciding whether said instruction instructed by said instruction means is the first instruction or the second instruction;

replacing means for replacing information stored in the first area when it is decided by said decision means that the first instruction is instructed by said instruction means;

display control means for displaying an icon pattern selected from a plurality of icon patterns stored in the second area based on the information stored in the first area on the display screen; and execution means for executing the object corresponding to the icon when it is decided by said decision means that the second instruction is instructed by said instruction means;

wherein a number of said icon storage means equals to a number of objects stored in said function storage means.

13. A data processing apparatus according to claim 11, wherein when the n-th icon is displayed, the n-th icon is changed to the first icon.

14. A data processing apparatus according to claim 12, further comprising:

measuring means for measuring a time, wherein the icon being displayed every time a predetermined time is measured by said measuring means is changed to one of other plurality of icons when an instruction is given by said instruction means.

15. A data processing apparatus according to claim 14, wherein n icons are stored in said storage means, and the i-th icon is changed to the (i+1)-th icon in accordance with an instruction by said instruction means.

16. A data processing apparatus according to claim 15, wherein when the n-th icon is displayed, the n-th icon is changed to the first icon.

17. A data processing method for instructing an icon displayed on a display screen and thereby operating on one of a plurality of objects corresponding to the instructed icon, comprising the steps of:

storing an object in an object storing means;

storing an icon in a first area (31) and a second area (33) of an icon storage means, the icon being assigned to the object;

storing a plurality of icon patterns in the second area and information relating to an icon pattern being displayed at present for the icon in the first area;

instructing a first instruction or a second instruction;

deciding whether said instruction instructed by said instructing step is the first instruction or the second instruction;

replacing the information stored in the first area when it is decided by said deciding step that the first instruction is instructed by said instructing step;

display control means for displaying an icon pattern selected from the plurality of icon patterns stored in the second area based on the information stored in the first area on the display screen; and executing an object corresponding to the icon selected by said selecting step when it is decided by said deciding step that the second instruction is instructed by said instructing step, wherein a number of said icon storage means equals to a number of objects stored in said object storage means.

18. A data processing method for instructing an icon displayed on a display screen and thereby operating on one of a plurality of objects corresponding to the instructed icon, comprising the steps of:

storing an object in an object storing means;

storing an icon in a first area (31) and a second area (33) of an icon storage means, the icon being assigned to the object;

instructing a first instruction or a second instruction;

deciding whether said instruction instructed by said instructing step is the first instruction or the second instruction;

sequentially compressing pixel data of the icon stored in said icon storing step;

replacing the information stored in the first area when it is decided by said deciding step that the first instruction is instructed by said instructing step;

displaying an icon pattern selected from a plurality of icon patterns stored in the second area based on the information stored in the first area on the display screen; and executing an object corresponding to the icon selected by said selecting step when it is decided by said deciding step that the second instruction is instructed by said instructing step, wherein a number of the icon storage means equals to a number of objects stored in the object storage means.

19. A display control method for instructing an icon displayed on a display screen and thereby executing one of a plurality of functions corresponding to the instructed icon, said method comprising the steps of:

storing a function;

storing an icon in a first area (31) and a second area (33) of an icon storage means, the icon being assigned to the function;

instructing a first instruction or a second instruction;

deciding whether said instruction instructed by said instructing step is the first instruction or the second instruction;

replacing information stored in the first area when it is decided by said deciding step that the first instruction is instructed by said instructing step;

displaying an icon pattern selected from the plurality of icon patterns stored in the second area based on the information stored in the first area on the display screen; and executing an object corresponding to the icon selected by said selecting step when it is decided by said deciding step that the second instruction is instructed by said instructing step, wherein a number from said step for storing an icon equals to a number of objects stored in said step for storing a function.

20. A computer usable medium having computer readable program code means for instructing an icon displayed on a display screen and thereby operating on one of a plurality of objects corresponding to the instructed icon, the medium comprising:

first program code means for storing in an object in an object storing means;

second program code means for storing an icon in a first area (31) and a second area (33) of an icon storage means, the icon being assigned to the object;

third program code means for instructing a first instruction or a second instruction;

fourth program code means for deciding whether said instruction instructed by said third program code is the first instruction or the second instruction;

fifth program code means for sequentially compressing pixel data of the icon stored in said second program code for storing an icon;

sixth program code means for replacing information stored in the first area when it is decided by said third program code that the first instruction is instructed by said third program code by displaying pixel data of the icon, sequentially compressed, and displaying the pixel data of an immediately subsequent icon for the same object, already compressed in a progressively expanding sequence; and seventh program code for executing an object corresponding to the icon when it is decided by said fourth program code that the second instruction is instructed by said third program code, wherein a number of the icon storage means equals to a number of the objects stored in the object storage means.

21. A computer usable medium having computer readable program code means for instructing an icon displayed on a display screen and thereby executing one of a plurality of functions corresponding to the instructed icon, the medium comprising:

first program code means for storing a function in a function storing means;

second program code means for storing an icon in a first area (31) and a second area (33) of an icon storage means, the icon being assigned to the function;

third program code means for instructing a first instruction or a second instruction; and fourth program code means for deciding whether said instruction instructed by said third program code is the first instruction or the second instruction;

fifth program code means for replacing information stored in the first area when it is decided by said third program code that the first instruction is instructed by said third program code by changing a column of pixels each composing the icon to a column of pixels of another icon for the same function in sequence in accordance with an instruction in the third program code means; and sixth program code for executing an object corresponding to the icon when it is decided by said fourth program code that the second instruction is instructed by said third program code, wherein a number of the icon storage means equals to number of the objects stored in the object storage means.

* * * * *

UNITED STATES PATENT AND TRADEMARK OFFICE

CERTIFICATE OF CORRECTION

PATENT NO. : 6,342,894 B1
DATED : January 29, 2002
INVENTOR(S) : Nojiri

It is certified that error appears in the above-identified patent and that said Letters Patent is hereby corrected as shown below:

Title page,
Item [56], U.S. PATENT DOCUMENTS, "Fleming etal." should read -- Fleming et al. --.

Column 2,
Line 26, "is" should read -- is a --.

Column 6,
Line 8, "no" should read -- no. --.

Column 7,
Line 61, "reference" should read -- reference to --.

Column 9,
Line 32, "($T_1$" should read -- ($T_{1-1}$ --.

Column 16,
Line 44, "means; and" should read -- means; --.

Column 19,
Line 17, "storing in" should read -- storing --.

Column 20,
Line 19, "instruction; and" should read -- instruction; --.

Signed and Sealed this

Eighteenth Day of February, 2003

JAMES E. ROGAN
*Director of the United States Patent and Trademark Office*